US010724315B2

(12) United States Patent
Leuchtenberg

(10) Patent No.: US 10,724,315 B2
(45) Date of Patent: Jul. 28, 2020

(54) MODIFIED PUMPED RISER SOLUTION

(71) Applicant: MANAGED PRESSURE OPERATIONS PTE. LTD., Singapore (SG)

(72) Inventor: Christian Leuchtenberg, Singapore (SG)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 171 days.

(21) Appl. No.: 15/552,806

(22) PCT Filed: Feb. 24, 2016

(86) PCT No.: PCT/GB2016/050465
§ 371 (c)(1),
(2) Date: Aug. 23, 2017

(87) PCT Pub. No.: WO2016/135480
PCT Pub. Date: Sep. 1, 2016

(65) Prior Publication Data

US 2018/0038177 A1 Feb. 8, 2018

(30) Foreign Application Priority Data

Feb. 25, 2015 (GB) ..... 1503166.9
Jan. 15, 2016 (GB) ..... 1600789.0

(51) Int. Cl.
*E21B 17/01* (2006.01)
*E21B 17/07* (2006.01)
(Continued)

(52) U.S. Cl.
CPC ..... *E21B 21/08* (2013.01); *E21B 17/01* (2013.01); *E21B 17/07* (2013.01); *E21B 21/001* (2013.01);
(Continued)

(58) Field of Classification Search
CPC ..... E21B 17/01; E21B 17/07; E21B 21/001; E21B 21/08; E21B 33/064
See application file for complete search history.

(56) References Cited

U.S. PATENT DOCUMENTS 2,158,356 A 5/1939 Dyer
6,102,673 A * 8/2000 Mott ..... E21B 21/001 137/596.17
(Continued)

FOREIGN PATENT DOCUMENTS

GB 2501094 A 10/2013
WO WO 2005/052307 A1 6/2005
(Continued)

OTHER PUBLICATIONS

C. Cole: "Double acting diaphragm pumps save space: ENGINEERLIVE", www.Engineerlive.com/content/double-acting-diaphragm-pumps-save-space, retrieved on May 11, 2016, pp. 1-2 (2016).

*Primary Examiner* — Matthew R Buck
(74) *Attorney, Agent, or Firm* — Norman B. Thot

(57) ABSTRACT

A riser assembly includes a main body which encloses a main body main passage extending from a first end to a second end which is generally parallel to a longitudinal axis, the main body being mounted in a riser so that that the main body main passage forms a part of a main passage of the riser. A first port and a second port extend through the main body to connect the main body main passage with an exterior of the main body. A tubular extends along the main body main passage. A first sealing assembly is arranged in the main body between the first port and the second port. The first sealing assembly provides a seal between the main body and the tubular. At least two diversion lines extend from the first port to the second port. A pump is arranged within each diversion line.

21 Claims, 7 Drawing Sheets

(51) Int. Cl.

| | |
|---|---|
| ***E21B 21/00*** | (2006.01) |
| ***E21B 21/08*** | (2006.01) |
| ***E21B 33/064*** | (2006.01) |
| *E21B 19/00* | (2006.01) |
| *E21B 33/08* | (2006.01) |

(52) U.S. Cl.
CPC ..... *E21B 33/064* (2013.01); *E21B 19/004* (2013.01); *E21B 33/085* (2013.01)

(56) References Cited

U.S. PATENT DOCUMENTS

| | | | | |
|---|---|---|---|---|
| 6,129,152 | A | 10/2000 | Hosie et al. | |
| 6,415,877 | B1 | 7/2002 | Fincher et al. | |
| 6,527,054 | B1 | 3/2003 | Fincher et al. | |
| 6,561,774 | B2 | 5/2003 | Layman | |
| 6,648,081 | B2 | 11/2003 | Fincher et al. | |
| 6,854,532 | B2 | 2/2005 | Fincher et al. | |
| 6,981,561 | B2 | 1/2006 | Krueger et al. | |
| 7,114,581 | B2 | 10/2006 | Aronstam et al. | |
| 7,264,058 | B2 | 9/2007 | Fossli | |
| 7,270,185 | B2 * | 9/2007 | Fontana | E21B 7/12 166/347 |
| 7,699,109 | B2 | 4/2010 | May et al. | |
| 7,913,764 | B2 | 3/2011 | Smith et al. | |
| 7,926,560 | B2 | 4/2011 | Bailey et al. | |
| 7,958,948 | B2 | 6/2011 | Stave | |
| 8,640,778 | B2 * | 2/2014 | Fossli | E21B 21/001 166/367 |
| 9,428,975 | B2 * | 8/2016 | Stave | E21B 17/01 |
| 9,963,947 | B2 * | 5/2018 | Kjosnes | E21B 33/085 |
| 2003/0066650 | A1 | 4/2003 | Fontana et al. | |
| 2007/0119621 | A1 | 5/2007 | Stave | |
| 2011/0100710 | A1 | 5/2011 | Fossli | |
| 2011/0236236 | A1 | 9/2011 | Larsen et al. | |
| 2011/0278014 | A1 | 11/2011 | Hughes et al. | |
| 2011/0297388 | A1 | 12/2011 | Stave | |
| 2012/0227978 | A1 | 9/2012 | Fossli et al. | |
| 2013/0168578 | A1 | 7/2013 | Leuchtenberg et al. | |
| 2013/0233562 | A1 | 9/2013 | Leuchtenberg | |
| 2014/0251693 | A1 * | 9/2014 | Rajabi | E21B 21/08 175/66 |
| 2015/0008036 | A1 * | 1/2015 | Ree | E21B 21/001 175/5 |
| 2015/0068758 | A1 | 3/2015 | Leuchtenberg et al. | |
| 2015/0122505 | A1 * | 5/2015 | Judge | E21B 47/101 166/368 |
| 2015/0252637 | A1 * | 9/2015 | Leuchtenberg | E21B 21/001 175/5 |

FOREIGN PATENT DOCUMENTS

| | | | |
|---|---|---|---|
| WO | WO 2009/123476 | A1 | 10/2009 |
| WO | WO 2010/095947 | A1 | 8/2010 |
| WO | WO 2011/058031 | A2 | 5/2011 |
| WO | WO 2011/128690 | A1 | 10/2011 |
| WO | WO 2012/003101 | A2 | 1/2012 |
| WO | WO 2012/127227 | A2 | 9/2012 |
| WO | WO 2013/055226 | A1 | 4/2013 |
| WO | WO 2013/115651 | A2 | 8/2013 |
| WO | WO 2013/135725 | A2 | 9/2013 |
| WO | WO 2013/184866 | A2 | 12/2013 |
| WO | WO 2014/049369 | A2 | 4/2014 |

* cited by examiner

MODIFIED PUMPED RISER SOLUTION

CROSS REFERENCE TO PRIOR APPLICATIONS

This application is a U.S. National Phase application under 35 U.S.C. § of International Application No. PCT/GB2016/050465, filed on Feb. 24, 2016 and which claims benefit to Great Britain Patent Application No. 1503166.9, filed on Feb. 25, 2015, and to Great Britain Patent Application No. 1600789.0, filed on Jan. 15, 2016. The International Application was published in English on Sep. 1, 2016 as WO 2016/135480 A1 under PCT Article 21(2).

FIELD

The present invention relates to a riser assembly and method of operating a riser assembly, for example, for use in drilling a subsea wellbore using a drilling system that dynamically controls the bottom hole pressure or equivalent circulating density during drilling of the wellbore.

BACKGROUND

Subterranean drilling typically involves rotating a drill bit from the surface or on a downhole motor at the remote end of a tubular drill string. It involves pumping a fluid down the inside of the tubular drill string, through the drill bit, and circulating this fluid continuously back to the surface via the drilled space between the hole/tubular, referred to as the annulus. This pumping mechanism is provided by positive displacement pumps, also referred to as mud pumps, that are connected to a manifold which connects to the drill string, and the rate of flow into the drill string depends on the speed of these pumps.

For a subsea wellbore, a tubular, known as a riser, extends from the rig at the water's surface to the top of the wellbore, which exists at subsea level on the ocean floor. It provides a continuous pathway for the drill string and the fluids emanating from the wellbore below the seabed. In effect, the riser extends the wellbore from the sea bed to the rig, and thus the total wellbore annulus also includes the annular volume of the riser.

Conventionally, the wellbore is open to atmospheric pressure and there is no surface applied pressure or other pressure existing in the system. The drill pipe rotates freely without any sealing elements imposed or acting on the drill pipe at the surface or subsea. There is no requirement to divert the return fluid flow or exert pressure on the system during these standard operations.

The bit penetrates its way through layers of underground formations until it reaches target prospects, i.e., rocks which contain hydrocarbons at a given temperature and pressure. These hydrocarbons are contained within the pore space of the rock (i.e., the void space) and can contain water, oil, and gas constituents, also referred to as reservoirs. Due to overburden forces from layers of rock above, these reservoir fluids are contained and trapped within the pore space at a known or unknown pressure, referred to as pore pressure. An unplanned inflow of these reservoir fluids is well known in the art, and is referred to as a formation influx or kick. An uncontrolled kick is referred to as a blow out event.

A fluid of a given density, also referred to as weight, fills and circulates the annulus of the drilled hole. The purpose of this drilling fluid/mud is to lubricate, carry drilled rock cuttings to surface, cool the drill bit, and power the downhole motor and other tools. Mud is a very broad term and in this context it is used to describe any fluid or fluid mixture that covers a broad spectrum from air, nitrogen, misted fluids in air or nitrogen, foamed fluids with air or nitrogen, aerated or nitrified fluids, to heavily weighted mixtures of oil and water with solids particles.

Most importantly, this fluid and its resulting hydrostatic pressure, defined as the pressure column of fluid exerts at the bottom of the hole from its given density and true vertical height, prevents the reservoir fluids at their existing pore pressure from entering the drilled annulus. The resultant bottom hole pressure (BHP) at the well bottom or at a given depth in the wellbore using this relationship between density and true vertical height of the drilling fluid system is the primarily method used for controlling the BHP to prevent an influx event from occurring in conventional drilling.

The bottom hole pressure (BHP) exerted by the hydrostatic pressure of the drilling fluid is therefore the primary barrier for preventing an influx from the formation.

BHP can be expressed in terms of static BHP or dynamic/circulating BHP. Static BHP relates to the BHP value when the mud pumps are not in operation (i.e., no circulation). Dynamic or circulating BHP refers to the BHP value when the pumps are in operation during drilling or circulating.

The drilling fluid must thus also exert a pressure less than the fracture pressure of the formation, the fracture pressure being where fluid will be forced into the rock as a result of pressure in the wellbore exceeding the formation's horizontal stress forces/matrix strength, leading to a failing or breakdown of the formation rock. Exceeding the formation fracture pressure causes the formation to fracture and the expensive drilling fluid to be lost as it flows outwards into the formation. The increased concentration of solids or drilled cuttings in the drilling fluid will result in an increase in density above the normal static mud weight, which could drive the BHP above the fracture pressure.

Depending on the magnitude of any incurred losses, as fluid is lost/flows outwards into the formation, there is high risk that the consequent decrease in the hydrostatic pressure in the well resulting from the decreasing fluid level height in the wellbore decreases the BHP to below the formation pressure. This undesired condition results in formation influx, described herein. These conditions are well known in the art, and are also referred to as losses (minor, major, and total/severe depending on the magnitude) or lost circulation.

Increased solids from drilling and the hydrostatic pressure of the column of fluid in the riser can reduce the amount of hole that can be drilled before having to set an additional casing string, depending on the existing fracture pressures. The solids can affect the rate of circulation, crating limits due to pressure and thus affects the ability to also clean the hole effectively. The extended riser height above the wellbore and the additional hydrostatic pressure becomes more pronounced as water depth increases. These conditions are amplified in deep and ultra-deep water wellbores, where the difference between fracture pressures in the shallow sections of the well and the pore pressures of the deeper sections is quite narrow compared to onshore wells. Therefore, to drill this type of deep water wellbore, the ECD must be reduced or controlled, and may mean the difference between incurring time and cost associated with setting an additional casing string to safely mitigate the problem.

Equivalent circulating density (ECD) is the increase in bottom hole pressure (BHP) expressed as an increase in pressure that occurs only when drilling fluid is being circulated. This pressure is different than the hydrostatic pressure as the ECD value reflects the total friction losses over the entire length of the wellbore annulus, from the point of fluid exiting the bit at the wellbore bottom to where it exits the return flow line at surface. The ECD can result in a bottom hole pressure during circulating/drilling that varies from slightly to significantly higher values when compared to static conditions (i.e., no circulation). The ECD is related to the circulating or drilling BHP in the sense that the ECD is calculated from the circulating/drilling BHP. The ECD value can increase with an increasing concentration of drilled solids/cuttings produced during the drilling of any formation and any increases in the mud viscosity properties during drilling, which can force the BHP above the fracture pressure. A high ECD thus poses a high risk in exceeding formation fracture pressures, with consequences described herein.

The goal of a conventional drilling system is therefore to maintain the BHP above the pore pressure but below the fracture pressure. The management of BHP can be referred to as managed pressure drilling (MPD) or ECD management.

As drilling progresses, pipe must be connected to the existing drill string to drill deeper. Conventionally, this involves shutting down fluid circulation completely so the pipe can be connected into place as the top drive must be disengaged.

During connection operations, the bottom hole pressure is largely affected, decreasing in value which can lead to a multitude of events such as influx, described herein, and cuttings drop out. On deeper wells, undesired large variances in the drilling fluid properties are created from high bottom hole temperatures when static flow conditions exist over a connection or other non-circulation period.

U.S. Pat. Nos. 6,527,054, 6,648,081, 6,854,532, 6,981,561, 7,114,581 7,270,185 describe the control of ECD.

In U.S. Pat. No. 7,270,185, the equivalent circulating density is controlled by controllably bypassing the returning fluid about a restriction in the returning fluid path of a riser utilizing an active differential pressure device, such as a centrifugal pump or turbine, located adjacent to the riser. The fluid is then returned into the riser above the restriction. The active differential pressure device is in the riser, outside the riser, or in an annulus of the wellbore. It is 1000 feet below the sea level to the sea bottom. It is a centrifugal pump, turbine, jet pump, or positive displacement pump. It controls equivalent circulating density of the drilling fluid in at least a portion of the fluid circuit.

In U.S. Pat. No 7,14,581 and U.S. Pat. No. 6,981,561, the bottom hole pressure and hence the equivalent circulating density is controlled by crating a pressure differential at a selected location in the return fluid path with an active pressure differential device to reduce or control the bottom hole pressure.

In U.S. Pat. No. 7,114,581, the subsea wellbore drilling system comprises an adjustable pump system in fluid contact with the annulus for regulating the fluid pressure at the bottom of the borehole at predetermined values during downhole operations in the wellbore to overcome at least a portion of the hydrostatic pressure and friction loss pressures of the return fluid.

In U.S. Pat. No. 6,981,561, the drilling system comprises a seal between the active differential pressure device and a drive assembly.

In U.S. Pat. Nos. 6,648,081 and 6,854,532, an adjustable pump is provided which is coupled to the annulus of the well. The lift provided by the adjustable pup effectively lowers the bottom hole pressure. The system described in U.S. Pat. No. 6,854,532 further comprises a flow control device in the subsea fluid circulation system. The control device is a remotely actuated choke for maintaining positive pressure of the fluid at the surface.

As mentioned above, these systems are large in magnitude, and must be installed through the side entry points of the moon pool area on an offshore installation. This increases installation time, complexity, operational safety risks at installation, and ultimately well costs due to the extended time periods during installation and removal.

A continuous circulation method has been developed by the applicant to achieve constant circulation through a side bore in the pipe at surface before the top drive is disengaged for a connection. Continuous circulation counteracts the negative effects on BHP associated with connections, it is therefore a critical process for managing and controlling BHP during connections. A description of one specific design for continuous circulation is described in U.S. Pat. No. 2,158,356.

The use of blow out preventers, referred to as BOP's, to seal and control the formation influxes, described herein, in the wellbore are well known in the art and are compulsory pressure safety equipment used on both land and offshore rigs. Whilst land and subsea BOP's (SSBOP) are generally secured to a sell head at the top of a wellbore, BOPs on offshore rigs are generally mounted below the rig deck and/or integrated into the bottom of the riser system on the ocean floor connected to the top of the wellbore.

On offshore rigs, a high pressure riser booster flow line connects a high pressure pump, referred to as the riser booster pump and identical in operation to a rig mud pump, to an inlet point (s) on the riser. These are normally located near the bottom of the riser above the subsea BOP to allow circulation of the entire riser volume/annulus over its entire length to surface. The riser booster flow line runs externally along the entire length of the riser system within a common rail. This system is used to generally increase the flow rate of fluid inside the riser for lifting cuttings in the large diameter riser conduit during drilling operations, but can also be used to circulate a gas influx from the riser volume and thus is partial to both the drilling and well control systems on the rig.

The annular BOP elements seal around the drill string, thus closing the annulus and stopping flow of fluid from the wellbore. They typically include a large flexible rubber or elastomer packing unit configured to seal around a variety of drill string sizes when activated, and are not designed to be actuated during drill string rotation as this rapidly wears or damages the sealing element.

A pressurized hydraulic fluid and piston assembly are used to provide the necessary closing pressure of the sealing element on the drill string. These closing times are typically slower due the large volume of power fluid that must be pressurized to operate the piston at a subsea depth.

WO 2013/135725 describes a new technology, a modified annular preventer, termed the Quick Closing Annular (QCA), which can rapidly seal the riser at a fraction of the closing time when compared to a standard annular. The inclusion of a QCA in the riser configuration therefore enhances both riser pressure control and well control, as its position isolates the pressure limiting component, the rig's slip joint, located at the riser top. However, it is not a necessary component for the inventive system and method, and can be substituted by a standard subsea annular.

Managed pressure drilling (MPD) utilizes additional special equipment that has been developed to keep the well closed at all times, as the wellhead pressures in these cases are non-atmospheric when compared to the traditional art of the conventional overbalanced drilling method, described herein. These thus operate as pressurized closed loop systems.

The closed loop is generated by a pressure seal around the drill pipe at surface or deeper in the riser configuration with a pressure containment device. Flow is diverted to a flow line by this device, referred to as a rotating control head (RCD or RCH), pressure control while drilling (PCWD), or rotating blow out preventer (RBOP), attached to a flow spool side outlet in the riser below the sealing point. The function of the rotating pressure containment device is to allow the drill string and its tool joints to pass through its sealing mechanism with reciprocation/stripping or rotation while maintaining pressure integrity around the tubular. With drilling activity in progress and the device closed, a back pressure is created on the annulus. The drill string is stripped or rotated through the sealing element (s) of the pressure containment device which isolates the pressurized annulus from the external atmosphere. With these devices, the sealing element rotates with the drill string while maintaining the pressure integrity of the seal. The rotation is handled by a bearing which may be a thrust, roller, cone or ball bearings or a combination of these which requires an internal bearing and seals prone to mechanical failure from the imposed loads of drilling. All are standard equipment and are commercially available with existing designs on the market. These are described in detail in U.S. Pat. Nos. 7,699,109, 7,926,560, and 6,129,152.

The applicant has also developed an alternative apparatus to the RCD technology, utilizing a non-rotating sealing device referred to as the Riser Drilling Device RDD, described in WO 2012/127227 and WO 2011/128690. This eliminates the requirement for a bearing assembly, with a single or dual seal sleeve assembly installed within a specified housing within the riser system and secured in place with hydraulically locking dogs/pistons. Rotation of the seal sleeve assembly with the drill pipe is prevented through the frictional forces of an adjacent annular packer assembly within the housing which applies pressure to the external surface of the seal sleeve when it is in position in the housing. The seal sleeve's mechanical structure and composite materials result in a high wear resistant low friction sealing face on the drill pipe. This system does not use the conventional bearing systems described in the prior art.

Complexity increases when MPD techniques are applied offshore, and specifically the deeper the water the more difficult these operations become. The riser section from the seabed floor to the drilling platform becomes an extension of the wellbore; as water depth increases the riser length increases accordingly, which increases the hydrostatic pressure and ECD effects exerted on the wellbore below, described herein.

The conditions described herein result in a narrow operating envelope for drilling, also referred to as a narrow drilling margin, and is defined as the small circulating/drilling BHP "window" resulting from the upper and lower constraints of lower fracture pressures and higher pore pressures at a total depth in the wellbore. The result is constraints in the flexibility within the circulating BHP during drilling and/or connections, posing challengers with even the most current and refined drilling methods.

A riser margin is additionally a safety factor desired in any offshore floating installation drilling operation. However, this cannot always be achieved given the water depth and formation pore and fracture pressures that are present for the well. A riser margin means that if the riser is disconnected, for example, in an emergency situation, the hydrostatic pressure from the drilling mud in the borehole and the seawater pressure above the seabed/subsea BOP is sufficient to maintain an overbalance against the formation pore pressure in the wellbore. A method which can allow a higher density drilling mud to be used below the subsea BOP would therefore increase the riser margin potential, and would thus be beneficial to the safety of the operation.

A deeper subsea set riser sealing solution for MPD using the RDD allows enhanced pressure and ECD control over the wellbore given its predetermined point of installation. It will allow the riser to be isolated so that the extended column of fluid above the sealing point can be isolated, eliminating its hydrostatic effects on the drilling annulus below, while allowing drilling to be performed (rotation and reciprocation) through the non-rotating sealing point. The deeper the set depth of the RDD, the higher the degree of controllability of the BHP results through the ECD, which is offset through isolating the hydrostatic pressure above its sealing point from the fluid column in the riser.

An active pressure differential device, such as a turbine, centrifugal pump or turbine, is disclosed in U.S. Pat. No. 7,114,581, and alters the pressure below in the wellbore to offset the ECD during drilling and circulating. The pump is either mounted within the drill string and moves in the wellbore with the drill string, or is alternatively attached to the wellbore and remains stationary relative to the drill string. An annular seal disposed around the active pressure differential device causes the return flow to flow into the pump suction. As the pump draws the fluid into its suction, it creates a differential pressure across the pump and draws down the wellbore pressure.

There have been many approaches in the attempt to find a safe and effective solution for drilling these challenging wells using riser pumping methods. Some of the more current concepts and technologies present today are AGR's EC-Drill system, Ocean Riser System's Lower Riser Return system (LRRS), and Deep Vision's Delta Vision system. These approaches are deemed "mid riser pumping" solutions, and are described below.

A dual gradient approach is described in detail in U.S. Pat. Nos. 6,415,877, 6,648,081, and 6,854,532, utilizing a subsea submersible centrifugal pump system. One embodiment of this application describes a riser-less system wherein a centrifugal pump connected to a separate return line controls the fluid flow to the surface, and in doing so counteracts the ECD effects during circulation. In this embodiment, the centrifugal pump is a standalone module connected to the returns annulus.

Another embodiment shows the submersible pump system mounted and fastened to a side outlet on a modified riser joint. A flow line extends from the outlet of the pump to the floating installation at the surface. During drilling and circulation, wellbore ECD is counteracted by energizing the pump and drawing the drilling fluid from the riser annulus and returning it to the surface. This in turn varies the fluid level height in the riser, and the submersible pump operates in conjunction with the rig drilling pump rate to maintain the required fluid height in the riser during drilling. The degree that the fluid height in the riser is increased or decreased (and its subsequent hydrostatic pressure variance) is equivalent to the ECD offset value desired for the well. During drilling, the pump decreases the fluid height in the riser and maintains it at a level where the decreased hydrostatic pressure is equivalent to the ECD value during circulation. During connections in absence of continuous circulation, the submersible pump is ramped down and the riser is filled to a level so that the pore pressure is balanced during the connection's static periods.

Additionally with this system, an optional delivery system may continuously inject a lighter density fluid than that of the mud weight being used into the returning fluid stream within the riser at a rate which can be controlled to provide a secondary regulation of the wellbore pressure.

With this system the BHP can be adjusted over minutes, versus the hours which would be undertaken to change the well over to a lighter mud weight. It also allows a heavier drilling mud to be used in the wellbore as a result of a reduced hydrostatic pressure above in the riser system from a reduced fluid level height (hence "dual gradient"), which will enhance hole cleaning and lubrication in the wellbore. This also may or may not create a sufficient riser margin for the well, depending on the formation pressures and water depth.

However, this system utilizes an inefficient pump technology for drawing fluid from the riser which may contain large solids particles. Centrifugal pumps operate at low efficiency in such operating conditions, and the big gaps in the blades of the impeller of the pump result in pump efficiencies of approximately 50%. The power requirements and mechanical size of the pump therefore increase to make up for this low efficiency to satisfy the fluid flow rate requirements, and results in a large dimensional footprint of the equipment, installation complexities, and large power requirements for its operation. This system also requires installation below the rotary table from the side of the moon pool which increases safety risks, time, and complexity during rig up.

The riser volume above the liquid level during operation of these systems is open to the atmosphere and thus kept at atmospheric conditions. Any gas escaping from the drilling fluid that may be entrained releases in the riser and migrates towards the atmospheric pressure above. Gas separation therefore occurs within the upper riser volume, and depending on the volume of gas breakout, it may be necessary to close in the surface diverter to prevent gas release to the surrounding atmosphere on the rig floor. Risk is thus involved with this method.

A large air gap may furthermore exist in the riser above the varied fluid level, along with an absence of a riser sealing device with this system, so that many operators deem such conditions unsafe. Decreasing the hydrostatic pressure/fluid level in the riser without a device in place to seal off the riser in an emergency is risky, and such conditions yield the potential for undesirable events to unfold.

Another dual gradient approach, described in detail in WO 2010/095947, describes similar design features and advantages as the previous system, with the exception that it incorporates a rotating sealing device around the drill pipe at surface or a surface BOP to seal off the riser. This gives the disclosed system an added safety contingency, sealing off the riser as the fluid level within the riser is decreased and providing a safety barrier which contains any gas breaking out from the drilling fluid. In an embodiment, it utilizes an independent return line from the outlet of the subsea pump attached to the riser which adjusts the fluid level within the riser and regulates the bottom hole pressure (BHP) of the wellbore. It operates with the same principle, moving towards the use of a heavier mud weight in the drilling annulus while using the submersible pump to control the fluid level of a lighter density fluid in the riser to offset the ECD of the well. The pump rate is controllable to regulate the interface between the two separate fluids at a consistent height in the riser, with the maximum pressure adjustment achievable being the fluid level between the rotating sealing device at surface and the inlet to the submersible pump.

A further progression and improvement to existing Lower Riser Return Systems (LRRS) is described in WO 2009/123476, which incorporates the use of an "annular seal" around the drill pipe at surface or at a subsea point within the riser during drill pipe connections. This is to compensate for the reduction in wellbore pressure when the injection into the drill pipe ceases, thus eliminating the ECD from the BHP. However, during drilling, the annular seal remains open with the option of installing a wiper or stripper element in the diverter to prevent any gas breakout escaping to the rig floor atmosphere. In addition to the annular sealing device, the disclosed system utilizes an independent return line from the outlet of the subsea pump attached to the riser fitted with a subsea gas liquid separator and subsea choke valve assembly to safely handle the removal of gas from the return fluid flow stream and venting this to the surface while regulating dynamically the annular pressure in the well. It operates within the same principle of dual gradient fluids, using the submersible pump to control the fluid level of a lighter density fluid in the riser to compensate for the ECD of the well. The installation and operation becomes more complex with this system with the increased amount of subsea equipment, with many of the same deficiencies as the systems described herein.

Yet another improved approach to pumped riser methods is described in U.S. Pat. No. 7,270,185 B2. The ECD is here controlled by the diversion of the return fluid flow from the wellbore around a deeper set subsea flow restriction, such as a rotary seal, set within the riser utilizing an "active differential pressure device", such as a centrifugal pump or turbine, to offset the ECD and adjust the BHP. The pump or turbine is located adjacent to the riser and is connected to a modified riser joint to a flow outlet existing below the sealing device, and reconnects with the riser directly above the sealing device. In an alternate embodiment, the outlet line below the sealing device does not reconnect with the riser, but connects to the floating installation at surface through a separate return flow line.

The centrifugal pump creates a pressure differential in the returning fluid as it draws fluid into its suction inlet from riser annulus below and discharges it into the riser annulus above the sealing device, with the amount of differential pressure across the pump regulated to the value of ECD offset desired for the wellbore. The submersible pump is mounted on a riser joint and installed within the riser configuration. The depth of the submersible pump and sealing device depends on the maximum desired reduction in the ECD. With this concept, there still remains the issue of a single submersible pump and return line, and therefore it lacks contingency for failures within the system, such as solids plugging of the pump or pump failure. The concept, however, addresses the issues of the ability to seal off the riser with the inclusion of a "rotary sealing device" which contains any gas breakout that may occur in the upper riser volume.

The well is also drilled with a relatively full fluid column present in the riser above the sealing point. The "sealing device" remains closed throughout operations and isolates the hydrostatic effects from the fluid in the riser section above it. The energized submersible pump continues to return fluid to the riser above, pumping fluid from below the sealing device and returning it to the riser annulus above the sealing device in an attempt to counteract ECD during drilling and circulation.

Further variations of the systems described herein are described in WO 2012/003101, WO 2005/052307, WO 2011/058031, and U.S. Pat. Nos. 7,264,058, 7,958,948, and 7,913,764.

SUMMARY

An aspect of the present invention is to provide an improved pumped riser system which enhances the overall safety of the floating installation and meets the challenges of increasingly complex deep-water wells.

An aspect of the present invention is also to provide a compact arrangement so that the modified riser module according to the present invention is easily connected to the rig's riser joints on the rig floor using a rig spider and lowering it through the rotary table, which are normal procedures during the running of the riser system. Installation complexities are thus eliminated which is a major difference when compared to other pumped riser systems with large dimensions, requiring their installation through the side of the moon pool area.

An aspect of the present invention is to maintain the advantages of pumps as described in US 2011/236236, but to also permit the modified riser module of the present invention to be lowered through the rotary table.

In an embodiment, the present invention provides a riser assembly which includes a main body comprising a first end, a second end, a longitudinal axis, a first port, and a second port. The main body is configured to enclose a main body main passage which extends from the first end to the second end generally parallel to the longitudinal axis and to be mounted in a riser so that that the main body main passage forms a part of a main passage of the riser. The first port and the second port are configured to extend through the main body to connect the main body main passage with an exterior of the main body. A tubular extends along the main body main passage. A first sealing assembly is arranged in the main body between the first port and the second port. The first sealing assembly is configured to provide a seal between the main body and the tubular so as to substantially prevent a flow of a fluid along the main body main passage around the tubular. At least two diversion lines extend from the first port in the main body to the second port in the main body. A pump is arranged within each of the at least two diversion lines. Each pump is configured to pump a fluid along a respective diversion line in which the pump is arranged.

BRIEF DESCRIPTION OF THE DRAWINGS

The present invention is described in greater detail below on the basis of embodiments and of the drawings in which.

DETAILED DESCRIPTION

Figure 1:
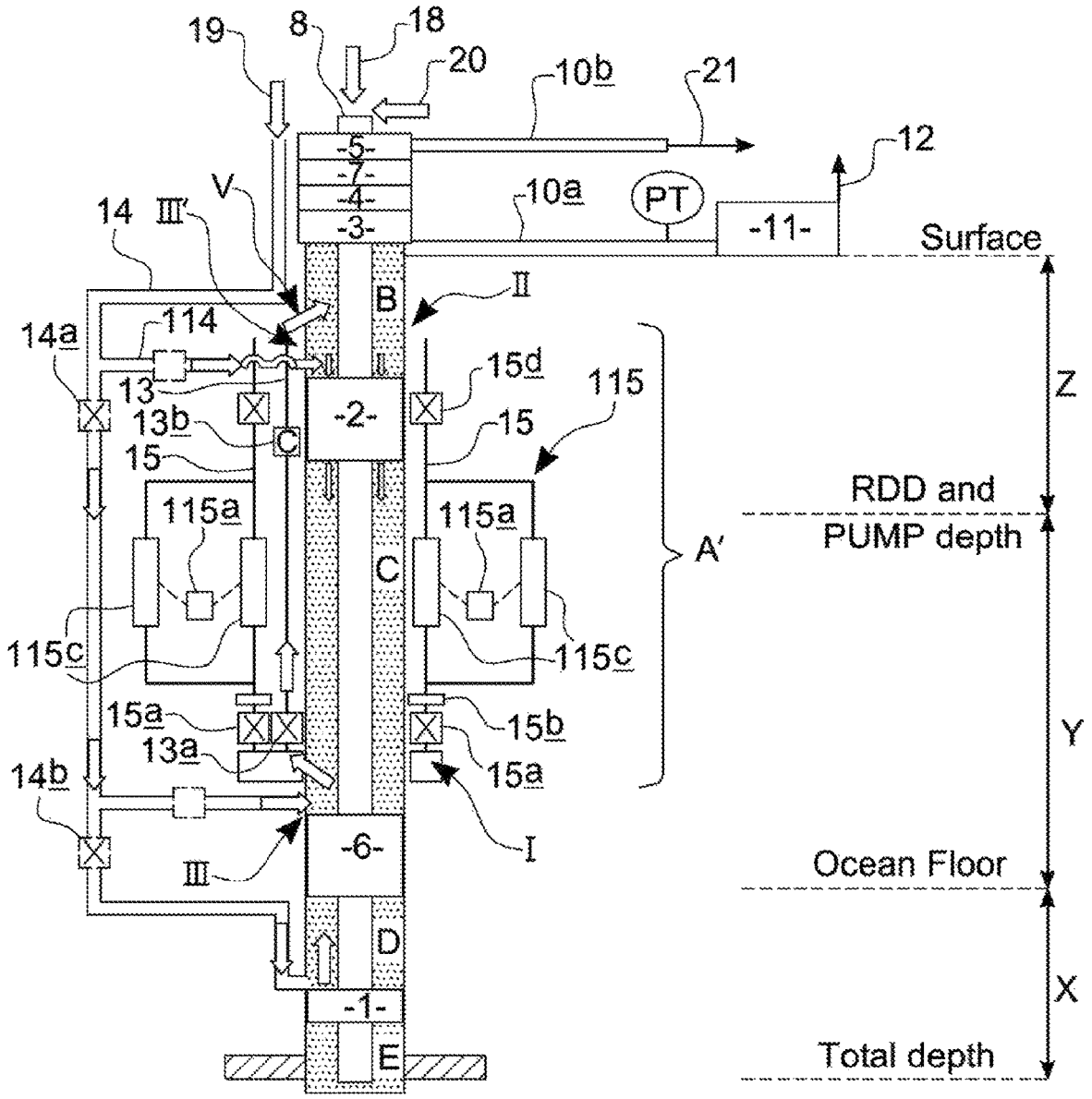
FIG. 1 shows an embodiment of the present invention showing the components of the inventive system within a riser system, with a QCA or RDD positioned at the riser top and the modified riser module containing the RDD, QCA and positive displacement pump modules, in this case, a hose diaphragm pump system(s) positioned at a deep set subsea depth.

According to a first aspect of the present invention, a riser assembly comprising a main body enclosing a main passage is provided which extends from a first end of the main body to a second end of the main body generally parallel to a longitudinal axis of the main body, the main body being suitable for mounting in a riser so that that main passage forms a part of a main passage of the riser, the riser assembly further including a sealing assembly which is operable to provide a seal between the main body and a tubular extending along the main passage of the main body so as to substantially prevent a flow of fluid along the main passage around the tubular, and two or more diversion lines, each of which extends from a first port in the main body to a second port in the main body, the ports extending through the main body to connect the main passage with the exterior of the main body, the sealing assembly being located in the main body between the first and second ports, wherein a pump is located within each diversion line, the pump being operable to pump fluid along the diversion line in which it is located.

In an embodiment, each diversion line can, for example, have a main portion which extends generally parallel to the longitudinal axis of the main body of the riser assembly.

In an embodiment, the diversion lines can, for example, be arranged to be abutting or directly adjacent to the main body.

In an embodiment, each pump can, for example, be a hose diaphragm pump.

In an embodiment, each pump can, for example, be a positive displacement pump.

In an embodiment, each pump can, for example, be operable to pump fluid along the diversion line from the first port to the second port.

In an embodiment, each pump module can, for example, consist of a single driver motor powering a pair of pumps in parallel. There may be more than one pump module. Each diversion line may be provided with a non-return valve which allows a flow of fluid along the diversion line from the first port to the second port whilst substantially preventing flow of fluid along the diversion line from the second port to the first port. The non-return valve may be located between the pump and the second port or may be an internal component of the pump itself A pump with internal check valve and with another check valve between pump and second port may also be used as a back-up.

Each diversion line may be provided with a filter which is located in the diversion line between the pump and the first port.

In an embodiment, each diversion line can, for example, be provided with a separate first port and second port.

In an embodiment, each diversion line can, for example, be provided with an isolation valve which is operable to move between a first configuration in which the isolation valve permits flow of fluid along the diversion line, and a second configuration in which the isolation valve substantially prevents flow of fluid along the diversion line. The isolation valve may in this case be located between the pump and the second port.

Each diversion line may be provided with a further isolation valve which is operable to move between a first configuration in which the further isolation valve permits flow of fluid along the diversion line, and a second configuration in which the further isolation valve substantially prevents flow of fluid along the diversion line, the further isolation valve being located between the first port and the pump.

In an embodiment, the riser assembly can, for example, be further provided with a booster line which extends to a third port provided in the main body, the third port connecting the main passage to exterior of the main body. The third port may in this case be located so that the imaginary planes perpendicular to the longitudinal axis of the main body containing the first ports lie between the sealing assembly and the third port. Alternatively, the third port may be located directly above the first sealing assembly in order to facilitate the flushing of cuttings above the seal assembly. The system may include both configurations as well.

In an embodiment, the booster line can, for example, extend from a booster pump.

In an embodiment, the riser assembly can, for example, further include a by-pass line which extends between a fourth port and a fifth port provided in the main body, the fourth and fifth ports connecting the main passage to exterior of the main body, the sealing assembly being located between the fourth and fifth ports.

The by-pass line may be provided with a by-pass isolation valve which is operable to move between a first configuration in which the by-pass isolation valve permits flow of fluid along the by-pass line, and a second configuration in which the by-pass isolation valve substantially prevents flow of fluid along the by-pass line. The by-pass line may be provided with a choke which is adjustable to vary the extent to which it restricts flow of fluid along the by-pass line.

In an embodiment, the riser assembly can, for example, include a further sealing assembly which is operable to provide a seal between the main body and a tubular extending along the main passage of the main body so as to substantially prevent flow of fluid along the main passage around the tubular, the first port being located between the two sealing assemblies.

A second aspect of the present invention provides a riser assembly comprising:

a riser body enclosing a main passage which extends from a first end of the riser to a second end of the riser generally parallel to a longitudinal axis of the riser, the second end of the riser being connected to a subsea blowout preventer suitable for mounting on a wellhead, a first sealing assembly and a second sealing assembly, both of which are operable to provide a seal between the riser body and a tubular extending along the main passage of the riser body so as to substantially prevent flow of fluid along the main passage around the tubular, a diversion line which extends from a first port in the main body to a second port in the main body, the first and second ports extending through the main body to connect the main passage with the exterior of the main body and the first sealing assembly being located in the main body between the first and second ports, a pump located within the diversion line and being operable to pump fluid along the diversion line from the first port to the second port, an isolation valve which is operable to move between a first configuration in which the isolation valve permits flow of fluid along the diversion line, and a second configuration in which the isolation valve substantially prevents flow of fluid along the diversion line, the isolation valve being located between the pump and the second port. As an alternative, the isolation valve may be located between the pump and the first port, a riser booster pump, a booster line which extends from the riser booster pump before dividing into a first branch which extends to a third port provided in the main body between the first sealing assembly and the second sealing assembly or above the first sealing assembly, the third port connecting the main passage to exterior of the riser body, and a second branch which extends into the main passage at the second end of the riser body, a by-pass line which extends between a fourth port and a fifth port provided in the main body, the fourth and fifth ports connecting the main passage to exterior of the main body, the first sealing assembly being located between the fourth and fifth ports, and a by-pass isolation valve which is operable to move between a first configuration in which the by-pass isolation valve permits flow of fluid along the by-pass line, and a second configuration in which the by-pass isolation valve substantially prevents flow of fluid along the by-pass line.

In an embodiment, the diversion line can, for example, be provided with a filter which is located in the diversion line between the pump and the first port, for example, at the inlet of the first port (as it will be discussed below).

In an embodiment, the by-pass line can, for example, be provided with a choke which is adjustable to vary the extent to which it restricts flow of fluid along the by-pass line.

In an embodiment, the riser assembly can, for example, further comprise a diverter mounted at the first end of the riser body. In this case, the riser assembly may further comprise a telescopic joint mounted between the diverter and the first end of the riser body.

The riser assembly may further comprise a flow spool mounted between the telescopic joint and the first end of the riser body.

The riser assembly may further comprise a third sealing assembly operable to provide a seal between the riser body and a tubular extending along the main passage of the riser body so as to substantially prevent a flow of fluid along the main passage around the tubular, mounted between the telescopic joint and the flow spool.

A third aspect of the present invention provides a method of operating a riser assembly, the riser assembly comprising a riser body enclosing a main passage which extends from a first end of the riser to a second end of the riser generally parallel to a longitudinal axis of the riser, a first sealing assembly and a second sealing assembly, both of which are operable to provide a seal between the riser body and a tubular extending along the main passage of the riser body so as to substantially prevent flow of fluid along the main passage around the tubular, a diversion line which extends from a first port in the main body to a second port in the main body, the first and second ports extending through the main body to connect the main passage with the exterior of the main body and the first sealing assembly being located in the main body between the first and second ports, a pump located within the diversion line and being operable to pump fluid along the diversion line from the first port to the second port, an isolation valve which is operable to move between a first configuration in which the isolation valve permits flow of fluid along the diversion line, and a second configuration in which the isolation valve substantially prevents flow of fluid along the diversion line, the isolation valve being located between the pump and the second port or between the pump and first port, a riser booster pump, a booster line which extends from the riser booster pump to a third port provided in the main body between the first sealing assembly and the second sealing assembly or directly above the first sealing assembly, the third port connecting the main passage to exterior of the riser body, a by-pass line which extends between a fourth port and a fifth port provided in the main body, the fourth and fifth ports connecting the main passage to exterior of the main body, the first sealing assembly being located between the fourth and fifth ports, a by-pass isolation valve which is operable to move between a first configuration in which the by-pass isolation valve permits flow of fluid along the by-pass line, and a second configuration in which the by-pass isolation valve substantially prevents flow of fluid along the by-pass line, wherein the method includes the following steps:

operating the second sealing assembly to seal against a tubular extending along the main passage of the riser body, and operating the booster pump to pump fluid into the main passage of the riser body via the third port.

In an embodiment, the method can, for example, further comprise operating the first sealing assembly to seal against a tubular extending along the main passage of the riser body, operating the isolation valve in the diversion line so the isolation valve substantially prevents fluid flow along the diversion line, and opening the by-pass isolation valve so that fluid flow along the by-pass line is permitted.

In an embodiment, the method can, for example, further comprise operating the first sealing assembly to seal against a tubular extending along the main passage of the riser body, operating the isolation valve in the diversion line so the isolation valve permits fluid flow along the diversion line, and closing the by-pass isolation valve so that it substantially prevents fluid flow along the by-pass line.

In an embodiment, the method can, for example, further include the step of operating the pump in the diversion line to pump fluid along the diversion line from the first port to the second port.

In an embodiment, the method can, for example, further include operating the first sealing assembly so that it does not seal against a tubular extending along the main passage of the riser body, operating the isolation valve in the diversion line so the isolation valve substantially prevents fluid flow along the diversion line, and operating the by-pass isolation valve so that it substantially prevents fluid flow along the by-pass line.

In an embodiment, the method can, for example, further include the step of controlling the riser pressure (and subsequently the wellbore pressure) by regulating the riser booster pump rate and/or the pump rate to modulate riser pressure. The seal between the drill pipe and seal assembly can be lubricated by relaxing the seal enough to leak drilling returns downward across the seal face but still maintain the desired pressure in the riser. The seal assembly seal could be relaxed further as another method of riser pressure control as well.

The control of the riser pressure in the riser assembly according to an embodiment of the present invention can also be achieved, for example, by modulating the choke on the by-pass line to adjust riser pressure. In fact, the first seal assembly can be used either for pumped riser operations or to support applied back pressure operations as seen in conventional MPD. When the by-pass line is closed and the flow diversion lines are open, the first seal assembly forms a seal around the drill string while the riser pumps control riser pressure. Alternatively, the flow diversion lines can be closed and the by-pass line can be open while riser pressure is controlled with a choke on the by-pass line and the first seal assembly forms a seal around the drill string.

In an embodiment, a tie-in to the riser booster line with a port directly above the first sealing element can, for example, direct riser booster pump flow to be used to flush cuttings away from the top of the seal assembly to better permit lubrication of the seal face.

Another type of pump can alternatively also be used. When another type of pump is used, some modification in the overall arrangement needs to be considered. In an embodiment, each pump can, for example, be a submersible pump.

In an embodiment, each pump can, for example, be a progressive cavity pump.

In an embodiment, the first port can, for example, be located between the first sealing assembly and the second sealing assembly, and method further comprises the steps of stopping operation of the booster pump, either opening the first sealing assembly so that it does not seal against a tubular extending along the main passage of the riser body, or opening the by-pass isolation valve so that flow of fluid along the by-pass line is permitted, or both, and reversing the normal operation of the pump in the diversion line so that it pumps fluid along the diversion line from the second port to the first port.

The inventive system and method provides a means for safely performing subsea wellbore drilling operations through an improved pumped riser system and method.

There is provided a riser assembly having a main body enclosing a main passage which extends from a first end of the main body to a second end of the main body generally parallel to a longitudinal axis of the main body. The main body is suitable for mounting in a riser so that the main passage forms part of a main passage of the riser. A sealing assembly is mounted in the main body, the sealing assembly being operable to provide a seal between the main body and a tubular extending along the main passage so as to substantially prevent flow of fluid along the main passage around the tubular.

The riser assembly may be installed in a riser at water depths ranging at least from 500 to 1000 meters. The depth of installation of the riser assembly will be determined by the maximum desired reduction in the ECD desired during drilling.

In an embodiment, the sealing assembly is of the kind described in WO 2012/127227 and WO 2011/128690, and will hereinafter be referred to as a Riser Drilling Device (RDD). This includes a dual seal sleeve assembly having two seals which are spaced along the longitudinal axis of the riser assembly to seal around the tubular at two different locations. When hydraulically energized, the dual seal sleeve assembly provides a non-rotating seal on the drill pipe, while allowing axial and rotational movement of the drill pipe for drilling. The RDD isolates the riser fluid column above its sealing point and eliminates its hydrostatic pressure effects on the drilling annulus below the sealing point. The RDD will be the primary barrier utilizing a dual packer sealing assembly to serve this function, providing a pressure containment device capable of isolating pressure above or below it.

The RDD also diverts the return fluid flow from the riser annular seal below the RDD into the inlet of a designated large diameter flow diversion line, referred to as the pump suction inlet, which is provided by a first port in the main body of the riser assembly. The flow diversion line extends from the first port to a second port in the main body. The first and second ports extend through the main body to connect the main passage with the exterior of the main body. The RDD is located between the first and second ports. In an embodiment, the first port can, for example, be directly below the RDD.

The riser assembly is provided with at least two such flow diversion lines so that flow of flow past the RDD is still permitted in the event that one of the flow diversion lines becomes blocked. In an embodiment, the riser assembly can, for example, be provided with three such flow diversion lines.

In an embodiment, the diversion lines can, for example, be equally spaced around the main body. For example, where three diversion lines are provided, they may be arranged in a generally triangular array when viewed in transverse cross-section.

Each flow diversion line can, for example, be provided with its own first and second port. Alternatively, one diversion line may be formed a branch line from another, the diversion lines thus utilizing the same first and second ports in the main body of the riser assembly.

In an embodiment, each diversion line can, for example, have a main portion which extends generally parallel to the longitudinal axis of the main body of the riser assembly. Each diversion line can, for example, be arranged to be abutting or directly adjacent to the main body so as to minimize the outer diameter of the riser assembly.

A positive displacement pump system is located in each flow diversion line being operable to pump fluid along the diversion line in which it is located. The pump system may be a hose diaphragm pump system in which a drive motor drives two pump heads which are each tied in to a single diversion line to pump fluid along that diversion line. In an embodiment, a submersible pump can, for example, be located within each flow diversion line, the pump being operable to pump fluid along the diversion line in which it is located. In both cases, the pump draws returned fluid from the riser annulus below the RDD (via the first port) and discharging it into the riser annulus above the RDD (via the second port).

A positive displacement pump, such as a hose diaphragm pump (HDP) as an example is desired due to the high pump efficiency (85%) attained with this design, and its ability to manage larger diameter solids particles, abrasives, and highly viscous fluids. A higher efficiency pump and fluid displacement results in smaller dimensional pump footprint and subsequent lower power requirements to drive/operate the pumps.

The positive displacement mechanism results in higher accuracy of actual fluid volume delivered through the pump. The centrifugal pumps used in current pumped riser systems have a very low pump efficiency of 30%, where the positive displacement pumps produce the same flow at a given RPM regardless of the existing discharge pressure. A smaller dimensional pump layout thus achieves the same volume output as centrifugal pumps normally used in these applications.

Additionally, these pumps do not allow reverse flow or "leak by" when they are not in operation, which prevents backflow from occurring back through the diversion line and into the drilling annulus below. The pump speed is controlled by regulating the power supplied to the electric motors which drive the pump. The installation point of the pump (HDP or PCP) and RDD is determined by the maximum desired reduction in ECD, and together they comprise the modified riser joint. The pump heads provide the necessary differential pressure to transfer the return drilling fluid and cuttings from the drilling annulus below the RDD to the riser annulus above against the force of the hydrostatic pressure of the existing fluid column. The full hydrostatic effects of the riser fluid column are not imposed on the drilling annulus below during static conditions due to the absence of internal leakage or fluid slip through the pump design. However, a check valve may be installed on the discharge of the pump as an added contingency. HDPs and PCPs are well known in the art and are a proven technology in drilling environments.

The pump heads will be designed such that they can withstand the subsea pressures at installation depths of 500 to 101000 meters. This is possible by placing them in a high pressure rated steel enclosure similar to the rating of the riser. The system can be designed for installation at a greater depth if an even larger BHP operating window is desired.

The pump heads are mechanically driven by an electric drive motor with a VFD, which are well known in the art. Power to these pumps may be supplied by the floating installation power or by a separate and independent power supply to a subsea electrical motor. The electrical cable OD is large enough to allow sufficient power for the horsepower required to drive a single pump at 500-101000 meters of water depth at its maximum volume output. The VFD requirements for the deliverable horsepower are governed by the maximum expected rig pump volume during drilling, such that they are properly sized to operate the pump to deliver the same volume output at the maximum expected discharge pressure.

When the system is using hose diaphragm pumps, each pump module consists of a subsea electric drive motor that powers several hose diaphragm pump heads. The drive motor reciprocates a shaft to power the pump heads. When the drive motor takes a stroke, control systems fluid is energized or de-energized resulting in one of the pump heads to be injecting drilling returns into the second port while another pump head is drawing suction from the first port.

When the system is using progressive cavity pumps, the electrical drive motors are connected to the PCP's via a coupling device. The manner in which the rotor turns within the stator complicates the mechanical design of progressive cavity pumps. The eccentric motion of the rotor stator arrangement means the pump must be fitted with universal joints to transmit power from the concentric rotation of the drive shaft to the eccentrically rotating rotor. These joints must transmit torsional and thrust loads and depending on the size of the pump, designs of this drive mechanism range from simple ball-and-pin mechanisms to heavy-duty sealed gear couplings.

The electrical motors are synchronized with the operation of the rig's drilling pumps through a central control module, so that a constant feed of drilling fluid to the suction inlet of the pump is achieved. Suction may otherwise be lost to the pump or the pump may become oversupplied. A loss of fluid supply to the suction inlet of the pump is, however, not detrimental to its operational life, as a pump can run "dry" (without fluid) over a given time interval without damage. A loss of suction event is undesirable at any stage during drilling, and the design of the pump mitigates this condition such that damage to the pump is avoided.

In order to achieve the required horsepower requirements for larger depths, the pumps may be designed as modules providing 2 stages with 2 pump systems and motors in parallel. By using two or more pumps in parallel in each diversion line, it may be possible to boost the total flowrate/pressure output compared to a single pump, whilst limiting the outer diameter of the riser assembly for a given horsepower output, and thus providing that the riser assembly can still be run through the rotary table. Operating pumps in parallel, but in a synchronized fashion can help smoothen out flow.

In an embodiment, each of the diversion lines can, for example, be fitted with a remote valve system upstream of the inline filter system (to be discussed below) and downstream of the hose diaphragm pump heads or downstream of the PCP rotor-stator assembly depending on the type of pump used. Each diversion line may be provided with an isolation valve which is operable to move between a first configuration in which it permits flow of fluid along the diversion line and a second position in which it substantially prevents flow of fluid along the diversion line. The isolation valve thus allows the isolation of each of the diversion lines and pumps when they are not in operation. They also isolate the pump heads in cases where reverse flow may be occurring back through the pump from worn seals/worn stator assembly.

In an embodiment, each isolation valve can, for example, be located between the pump and the second port.

In an embodiment, each diversion line can, for example, be provided with two such isolation valves, with the pump being located between the two isolation valves.

Each diversion line may or may not be fitted with a check valve assembly on the discharge/outlet of the HDP. This would result in one way flow, and immediately prevent backflow from occurring through the HDP if the HDP seals are worn. The possibility of the static wellbore annulus pressure increasing from worn seals is thus eliminated. However, this may also be accomplished by closing the isolation valves described herein, upon a pump shutdown even to quickly isolate the pump.

The HDPs accommodates a wide range of fluid flow rates, which will vary depending on the section of the wellbore being drilled. Top hole sections require higher flow rates while deeper hole sections require smaller flow rates to satisfy hole cleaning requirements. For example, a minimum of 1,200 gpm fluid flow rate is required while drilling 17½ inch and larger upper hole sections and 750 to 1,100 gpm for a 12¼ inch section; these are industry standards and achieve the necessary annular velocities for hole cleaning. If the inventive system is to be utilized on these sections, the HDP would need to be sized such that it is capable of pumping at these injected flow rates, as a bare minimum.

In an embodiment, the riser assembly can, for example, be provided with a further sealing assembly which is operably to provide a seal between the main body and a tubular extending along the main passage of the main body so as to substantially prevent flow of fluid along the main passage around the tubular, the first port being located between the two sealing assemblies.

In an embodiment, the further sealing assembly can, for example, be a subsea annular or QCA as described in WO 2013/135725, which is installed below the RDD and riser inlets where the riser booster line, the large internal diameter bypass line, and flow diversion lines are connected. The further sealing assembly will hereinafter be described as the QCA.

The QCA position provides an additional safety barrier within the riser, but more so its inclusion in the inventive system is for isolating the riser module above it. The riser module of the inventive system contains the RDD, the pumps, the bypass line, and the flow diversion lines. The ability to isolate the riser module with the QCA permits high volume flushing of the confined volume between the RDD and the QCA, the bypass line, and the suction inlets for the pumps. This QCA also provides a contingency measure for the RDD sealing assembly when it requires replacement, and an additional safety barrier in the riser when gas is present.

In an embodiment of the inventive system and method, an additional QCA can, for example, be installed at or near the riser top. This is an optional configuration providing a secondary safety measure to quickly seal off the riser top if gas in solution passes through the pumps and breaks out in the riser annulus above the RDD. This allows the proposed configuration to safely contain the gas volume in the upper riser section and prevent gas from escaping through the rotary table at the riser top. The rig's diverter system may alternatively be used at the expense of a much slower closing speed.

The inventive system utilizes a subsea control pod for its operational interfaces between the surface and subsea. These may be, but are not limited to, hydraulic, electrical power, and communications for the modified riser module. The subsea control system design may not be restricted to a pod design. The hydraulic system can, for example, be in the form of a manifold.

An important issue to be addressed with the inventive system and method is regulating the solid particle size within the return fluid flow stream entering the suction inlet to avoid exceeding the operating tolerances of the pump. Top hole sections (17½ inch and larger) tend to result in larger solids particle sizes due to unconsolidated formations closer to the seabed floor which could exceed the maximum solids size allowance for the pump heads. For smaller hole sizes, solids particle sizes could still potentially exceed this tolerance while drilling through unstable shale formations and changes in bed dipping angles, where larger diameter solids are common due to hole sloughing and cave ins.

Therefore, as a contingency, each diversion line may be provided with a filter assembly to filter out larger solids particles and prevent the invasion of such particles into the pumps. For example, if the maximum allowed solids particle size through the pump is 2" when using HDPs and 1.25" when using PCPs, an upstream filter assembly containing screens with a machined array/pattern of 1" holes would be in place. The hole pattern would be machined such that the required cross sectional flow area of the pump is not impeded, and therefore as a minimum the total flow area of the filter is equal to the optimal flow area of the pump inlet.

A method for flushing solids may involve pumping viscous pills or clean drilling mud across the confined annulus between the RDD sealing point and a closed QCA, circulating the pill through the large diameter bypass line using a riser booster pump through a booster line. This will flush solids from the filter screen. In another option, viscous pills or clean drilling mud may be pump across a closed QCA and By-Pass line and up past a relaxed RDD seal.

When using PCPs, there are other methods which may be used to control solids plug off in the PCP's are, but not limited to, a subsea high flow rate macerator pump design installed upstream of the PCP's. It is also possible to operate the PCP's in reverse to permit reverse flow through pump and filtering system, but this requires a detailed precautionary procedure to provide the wellbore pressure does not increase above the fracture pressure threshold. This may be achieved by closing the QCA to isolate the wellbore annulus and opening the RDD or the bypass line.

In order to achieve this, in an embodiment, the riser assembly can, for example, include a booster line which connects to a third port provided in the main body of the riser assembly, the third port connecting the main passage to the exterior of the main body. In this embodiment, the third port is located so that the imaginary planes perpendicular to the longitudinal axis of the main body containing the first port(s) lie between the RDD and the third port. The booster line extends from a riser booster pump which is connected to a reservoir of flushing fluid, and which is operable to pump this flushing fluid into the main passage of the riser assembly via the third port. This allows a high volume rate of low solids flushing fluid to be pumped across the flow area, creating turbulence and flushing larger particle solids away from the suction inlets of the pumps. With the subsea annular or QCA closed below, high flow can be pumped across the riser annulus and through the large diameter bypass line without affecting the wellbore pressure below. The entry angle of the flush stream into the riser may be such that the high rate fluid stream is directed downwards and towards the suction inlets and to the top of the QCA. A direct stream has the best chance for flushing solids from these areas.

In an embodiment, jetting ports or nozzles can, for example, be oriented at specific radial positions on the riser module, with the flow stream of the nozzle positioned at a predetermined angle oriented downwards from the vertical axis, and discharging at points directly above the QCA and the RDD. A smaller diameter such as, but not limited to, one inch may provide a high velocity fluid stream to achieve sufficient turbulence for clearing settled solids in these areas.

In an embodiment, the riser assembly can, for example, be provided with a by-pass line which extends between a fourth port and fifth port provided in the main body, the fourth and fifth ports connecting the main passage with the exterior of the main body. The RDD is located between the fourth and fifth ports. In an embodiment, the fourth port can, for example, be located between the first port(s) and the RDD, whilst the fifth port is located between the second port(s) and the RDD.

The by-pass line is advantageously a large diameter by-pass line equipped with a minimum of one remotely operated isolation valves, each of which are operable to move between a first configuration in which it permits flow of fluid along the by-pass line and a second position in which it substantially prevents flow of fluid along the by-pass line, and a subsea choke which is adjustable to vary the extent to which it restricts flow of fluid along the by-pass line. The bypass line re-connects to the riser by a side inlet directly above the RDD, and functions as a high volume flushing line and riser gas bleed line. During a flushing procedure, the bypass line works in conjunction with the riser booster pump and modified riser booster line to flush large diameter solids from the suction inlets of the pumps and to clear solids which may have settled on top of the RDD sealing assembly.

The bypass line is coupled with a subsea choke which allows controlled bleeding of riser gas from the riser annulus below the RDD. The subsea choke permits any riser gas present below the RDD to be slowly bled in stages into the riser annulus above the RDD, where it is contained and safely handled by either the rig's diverter system or a surface QCA and Riser Gas handling (RGH) system.

A central control system, comprised of a single or multiple microprocessor, computer, and programmable logic controller (PLC) well known in the art, collects all incoming data streams for pressure, temperature, and flow rate from subsea sensors transmitting signals through the control pod and umbilical to surface. These are used for regulating the pump speeds and synchronizing their operation with the rig pump speed. The pump and rig drilling pump operate in parallel to maintain a constant BHP and riser fluid level during drilling and circulation. The pump is energized immediately upon initiating pumping with the rig pump, and its speed is automatically adjusted after analyzing changes detected in the rig pump speed, flow rates, and pressures. The resultant pump flow rate thus always matches the flow rate of the rig pump during drilling. The flow output of the pump heads may be accurately measured by a Coriolis meter, well known in the art.

The synchronized operation with the central control system thus regulates the speed of the pump to effectively control the supply of drilling fluid to its suction inlet, such that returned drilling fluid is pumped around the closed RDD at a rate equal to the drilling rate. This provides there are no pressure variations in the sealed wellbore annulus below the RDD The central control system includes an alarm and emergency feature which may shut down the pump when solids plugging occurs, switching over to a contingent pump and associated diversion line so drilling operations can continue. This is detected in the central control system through changes in one or more of the following; pump speed and power draw, measured flow rates through the pump and at surface, wellbore annulus pressure below the RDD, and inlet and discharge pressures of the pump. The pump and associated diversion line may be equipped with pressure sensors upstream and downstream of the pump, and upstream of the filter assembly to assist in monitoring for solids plugging, fluid losses, formation influx, and pump problems. They may be equipped with a flow sensor which detects changes occurring through the pump, accurately measuring the pump output. Changes in the flow rates may be indicative of solids plugging, formation influx, fluid losses, and pump problems.

The electrical motors driving the pump heads may be equipped with a motor speed sensor which allows the RPM of the electric motor and pump to be monitored accurately. Changes in the motor speeds may be indicative of solids plugging, formation influx, fluid losses, or pump problems.

The electrical motors driving the pump heads may be equipped with a power draw meter (amperes or volts) which further assist in the detection of solids plugging and pump problems.

As mentioned above, an embodiment of riser assembly according to the present invention incorporates two diversion lines and two HDP installed adjacently to the riser tube within the modified riser module to provide contingency for solids plug off and/or pump failure. It achieves this with a maximum OD design envelope of 57.5 inches so that the module can be installed into the riser at the rotary table and drifted through the rotary table and diverter housing which have a 60 inch internal diameter or greater. The inventive system is integrated and contained within a single modified riser joint of any riser type currently in use. Due to its compact OD, the riser module will also have the ability to drift through the rig's tension ring housing when the tensioner is not engaged. This simplifies complexities during installation and removal from the rig's riser system. Current pumped riser systems cannot achieve this, and this is a key difference in its design. Of course for rig installations on newer and deeper drilling depth capable rigs where a minimum of 70 inch or larger rotary/diverter housing diameters are available, the design can make use of the additional space available as long as the complete system can be deployed through the rig floor.

The inventive method and system utilizes a single density fluid throughout the entire wellbore and riser annulus. Using a single density fluid simplifies fluid mixing and storage on the floating installation, and results in reduced operational complexity in the wellbore and riser annulus during circulation while still achieving a "dual gradient" effect during drilling.

The proposed system can operate in parallel with any MPD system currently in use, which allows backpressure to be added to the drilling annulus if required. This requires the installation of an RDD or alternate pressure containment device near the riser top to permit the application of backpressure to the riser during drilling.

The proposed system can operate in parallel with the RGH system technologies, which would enhance the riser gas handling capacity of the overall drilling system.

The inventive system eliminates the requirement and risks associated with a separate and extended flow line to surface from the pumping module, which is associated with some of the riser pumping systems used today.

The inventive system and method can be used with, modified into, or integrated into any floating installation such as drill ships and semi-submersibles.

The inventive system and method result in operating with a full riser during drilling and circulation, which is in contrast to dual gradient pumped riser methods using two different fluids. This provides an added safety measure in addition to the RDD and QCA, as the additional hydrostatic pressure can be immediately applied to the drilling annulus if required for well control.

Embodiments of the present invention will now be described below under reference to the drawings.

Figure 2:
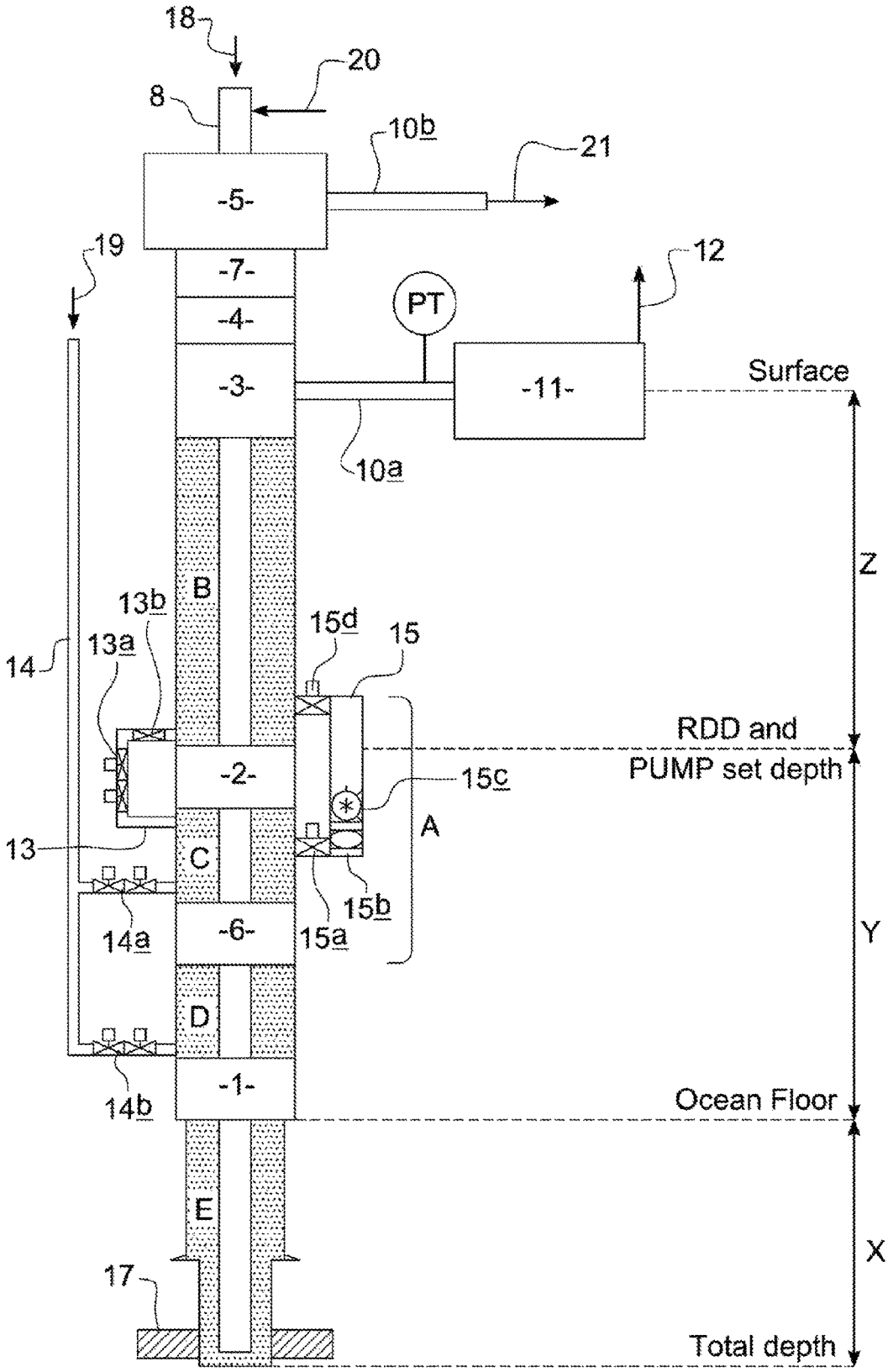
FIG. 2 shows an alternative embodiment of the embodiment shown in FIG. 1 when the modified riser module contains the RDD, QCA and submersible PCP's positioned at a deep set subsea depth.

Referring now to FIGS. 1 and 2, this illustrates a possible location of a riser assembly according to the present invention within a riser system on a floating installation using a deep subsea set RDD and QCA, and with a surface QCA or RDD installed at the riser top. This configuration, referred to as configuration 1, allows MPD or RGH operations to operate in parallel with the inventive system.

A QCA or RDD 4 is installed in the top of the riser below the rig's diverter 5 and telescopic joint 7, and is the primary safety measure to seal off the riser top if gas breakout occurs in the riser annulus B above the closed subsea RDD 2. Furthermore, with an RDD or QCA 4 installed at the top of the riser, an MPD or RGH system 11 can operate in parallel with the inventive system. A flow spool 3 is installed below the RDD or QCA 4, and a flow line 10*a* connects the flow spool 3 to the MPD or RGH system 11. With or without the HDP pump heads 115*c* in operation, surface pressure PT can be applied by an MPD or RGH system 11 to the riser annulus B, C, D and wellbore annulus E to control the formation 17 being drilled. All fluid returns from the annulus B, C, D and E are diverted to the MPD or RGH system 11 through the attached flow line 10*a*, the fluid is degassed, and gas is vented 12 to a safe area away from the rig. An RDD 4 allows drill pipe 8 rotation and reciprocation for drilling and could also act as the primary riser sealing mechanism during conventional drilling or during pumped riser operations. This arrangement thus provides enhanced safety and multiple options for drilling (MPD versus conventional versus pumped riser methods). A subsea blow out preventer SSBOP 1 is installed at the ocean floor.

During conventional drilling, fluid is injected by the rig's mud pumps 18 into the drill pipe 8 which extends through the riser annulus B, C, D and into the wellbore annulus E. The drilling fluid circulates into the wellbore annulus E at depth X below the ocean floor. All drilling fluid returns from the riser annulus B, C, D, and wellbore annulus E and are under atmospheric pressure and flow to the rig's fluid treatment system 21 through the diverter return flow line 10*b* connected to the diverter 5. For the drilling system depicted, the total length of the riser system is Y+Z, the well depth is X, and the total depth is X+Y+Z.

The inventive riser assembly described above is labeled A', and is installed within the rig's riser system, connecting to the riser at the top and bottom of the riser assembly A'. In FIG. 1, the riser assembly contains a subsea QCA 6, RDD 2, a large diameter bypass line 13, and two flow diversion lines 15. For this example, each flow diversion line 15 contains a HDP module 115 (which will be referred as the HDP 115 in the following description) with a drive motor 115*a* powering two pump heads 115*c*, a filtering system 15*b*, and hydraulically actuated isolation valves 15*a* and 15*d*. The flow diversion lines 15 connect the lower riser annulus C to the upper riser annulus B, allowing the HDP 115 to draw fluid from annulus C and discharge it into annulus B when the RDD 2 is closed for pumped riser operations. Each diversion line 15 is connected on one end to the main body of the riser assembly by a first port I in the main body so as to connect with annulus C and at the other end by a second port II in the main body so as to connect with annulus B. Valves 15*a* and 15*d* allow the diversion line 15 to be isolated; such is the case when there is a pump head 115*c* failure, preventing reverse flow of fluid from riser annulus B into riser annulus C. It may be an option to install a check valve (not shown) downstream of the HDP 115 to further mitigate reverse flow through a potentially damaged pump head 115*c*. Additionally, if the check valve seals, internal to the HDP head 115*c*, begin to fail, the isolation valves can be synchronized with the drive motor to facilitate the pumping.

In FIG. 2, the riser assembly contains a subsea QCA 6, RDD 2, a large diameter bypass line 13, and three flow diversion lines 15. For this example, a single flow diversion line is depicted, but it will be appreciated that more than one, and, for example, three flow diversion lines 15 are contained within the modified riser module A as discussed above. Each flow diversion line 15 contains a submersible PCP 15*c*, filtering system 15*b*, and hydraulically actuated isolation valves 15*a* and 15*d*. The flow diversion lines 15 connect the lower riser annulus C to the upper riser annulus B, allowing the submersible PCP 15*c* to draw fluid from annulus C and discharge it into annulus B when the RDD 2 is closed for pumped riser operations. Valves 15*a* and 15*d* allow the diversion line 15 to be isolated; such is the case when there is a pump 15*c* failure, preventing reverse flow of fluid from riser annulus B into riser annulus C. It may also in this case be an option to install a check valve (not shown) downstream of the PCP 15*c* to further mitigate reverse flow through a potentially damaged pump 15*c*.

During normal operating conditions with the inventive system and method, the subsea RDD 2 is closed, the subsea QCA 6 is open, and a single flow diversion line 15 is open to allow the pump (HDP 115, or PCP 15*c*) to draw fluid from annulus C and discharge it into annulus B. The pump (HDP 115 or PCP 15*c*) draws fluid at the same rate as the rig pump 18 is injecting drilling fluid into the drill pipe 8. With the RDD 2 closed, the hydrostatic pressure of the fluid in the riser annulus B above it with column height Z isolated from the wellbore below C D E, thus this pressure is not imposed on the formation 17. Depending on well conditions, the returned fluid may be directed to flow line 10*a* or 10*b*. If gas is present, the surface QCA or RDD 4 is closed and flow is diverted through flow line 10*a* to the riser gas handling or MPD equipment 11 at pressure PT. Under normal conditions with no gas, the surface QCA or RDD 4 is open and all return flow is diverted through flow line 10*b* under atmospheric conditions to the rig's fluid treatment system 21.

The bypass line 13 contains an isolation valve 13*a* and a hydraulically actuated subsea choke 13*b*. The bypass line 13 connects the lower riser annulus C to the upper riser annulus B, allowing circulation between the two annuli B and C. The isolation valve 13*a* allow the bypass line 13 to be isolated when it is not in use. The subsea choke 13*b* provides a means to safely control any gas present in the riser annulus C and D below the closed RDD 2, bleeding gas off in stages into riser annulus B above the RDD 2. Under these conditions, configuration 1 safely removes the gas by closing the surface RDD or QCA 4 and diverting all return flow to the flow line 10*a* and into the RGH or MPD system 11 to degas the fluid. During normal operating conditions with the pumped riser method, the bypass line 13 is closed.

The modified riser module is installed at a subsea depth Z from the surface, at a distance Y above the subsea BOP 1 above the ocean floor with a typical installation depth Z of 500 to 1000 meters. Deeper depths are possible if a greater BHP operating window is required.

A modified riser booster line 14 is installed and connected to the riser booster pump 19 to allow the injection of fluid into the riser annulus B, C and D. The modified riser booster line 14 provides the main flushing system for the modified riser module A when it is in operation to mitigate solids settling and plugging within the inventive system. The modified riser booster line 14 connects to the modified riser module A between the subsea QCA 6 and the subsea RDD 2 via a port III. Injected fluid from the riser booster pump 19 injects a highly turbulent fluid stream into riser annulus C between the RDD 2 and the QCA 6 by opening the hydraulically actuated isolation valves 14*a*.

Alternatively, a riser booster tie-in 114 can be used directly above the RDD seal assembly 2 to inject rapid, turbulent flow above the RDD seal to flush away cuttings. In this case the injection port III' will be located directly above the RDD 2. This tie-in can be used simultaneously with the riser booster tie-in above the QCA or at a different point in time. The booster line 14 can hence be provided with two ports III and III' in the riser portion above the QCA as shown in FIG. 1.

The riser annulus D and wellbore annulus E are isolated by closing the subsea QCA 6. Using this line 14, the bypass line 13 and flow diversion lines 15 can be flushed and cleared of any solids which may have settled, and pump 15*c* and the filtering system 15*b* can be flushed through if solids are beginning to plug off the filter.

It should be noted that the filter can also be installed at the inlet of the first port I (upstream of the isolation valve) as an option to make removing debris that is beginning to plug the filter more easily. The other riser booster tie-in 114 injects clean fluid to flush the top of the RDD to flush away cuttings and thereby facilitate lubrication past the RDD seal face during drilling.

In FIG. 2, if the filter system 15*b* becomes plugged, it can be back flushed by the reverse operation of the PCP 15*c* through the diversion line 15, with the QCA 6 closed beneath the RDD 2 such that the riser annulus D and wellbore annulus E are isolated. The flushing system also allows gas which may be present or trapped below the RDD 2 to be flushed through the bypass line 13 and into riser annulus B. During flushing operations drilling is normally stopped.

The modified riser booster line 14 still connects to the bottom of the riser as in conventional drilling operations, with flow permitted into the riser annulus D through the hydraulically actuated valves 14*b* when they are open. However, normally there is no injection through this point with the riser booster pump 19 during pumped riser operations.

According to the present invention, the riser booster tie-ins can be provided with check valves in place of isolation valves and the tie-in line is small, for example 1.5". In this case, the tie-in lines will constantly provide a small volume high speed flow for flushing, while the majority of riser booster pumped volume will be delivered through the conventional riser booster tie-in at the base of the riser. In this configuration, there will be injection into the base of the riser during pumped riser system operations. Finally, the system could also be operated such that, pumped riser system operations periodically cease so the riser booster pumped volume can be injected through the tie-in lines. As such, flushing could take place periodically so that pumped riser system operations can commence with the full riser booster pumped volume delivered directly to the base of the riser.

The inventive system and method is used in combination with a continuous circulation system 20 during connections for improved control over the wellbore E pressure during connection periods and results in a more efficient operation of the inventive system and method. Continuous circulation eliminates the requirement to stop the pump (HDP 115, or PCP 15*c*) operation during a connection, as circulation into the drill pipe 8 remains uninterrupted. However, in the absence of continuous circulation 20, when the rig pump 18 stops injecting fluid into the drill pipe 8 the pump (HDP 115, or PCP 15*c*) operation must cease.

Figure 3:
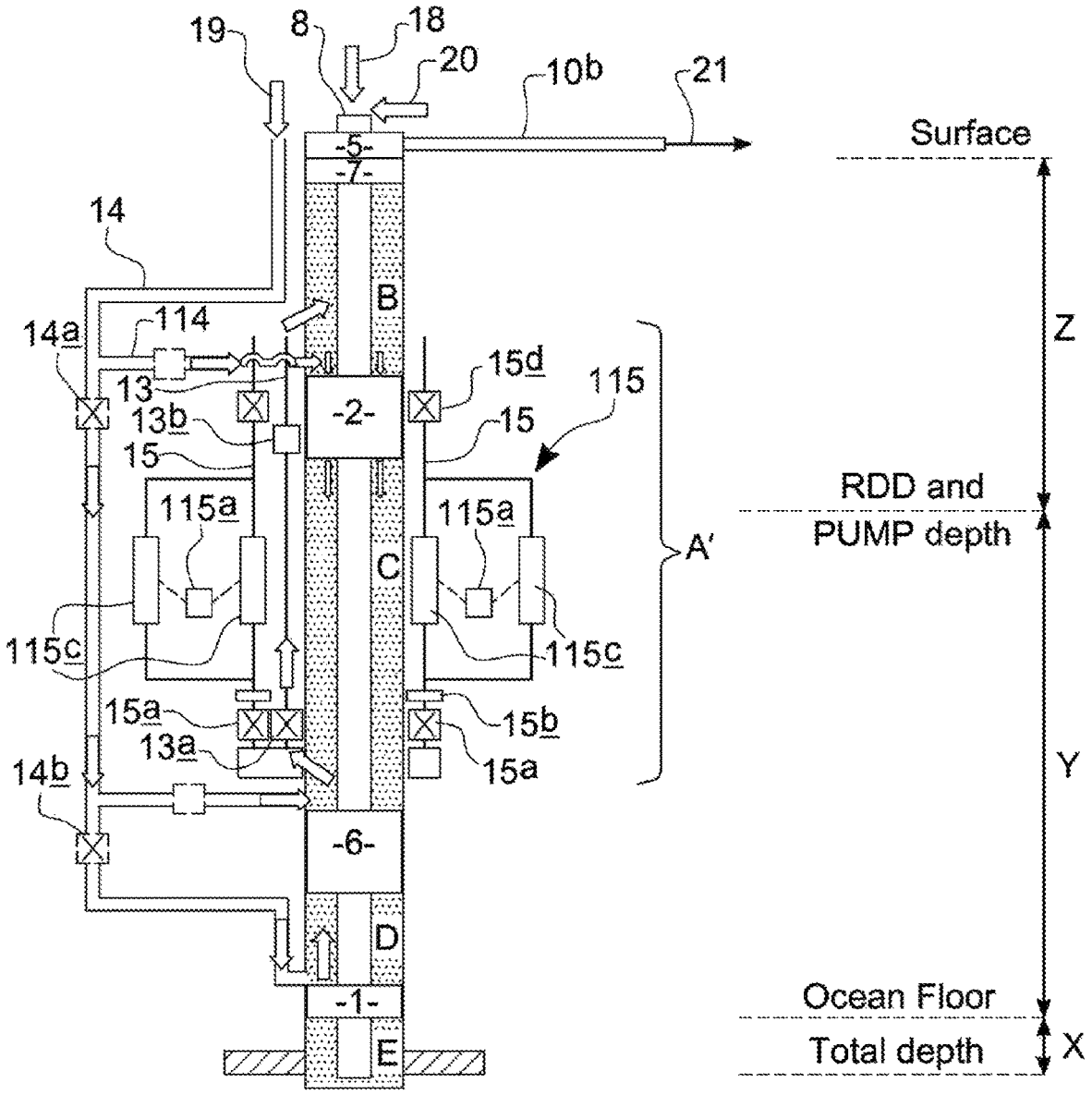
FIG. 3 shows an embodiment of the present invention showing the components of the inventive system installed within a riser system, with the modified riser module containing the RDD, QCA and positive displacement pump modules, in this case, hose diaphragm pump systems positioned at a deep set subsea depth and absence of a surface RDD or QCA.
Figure 4:
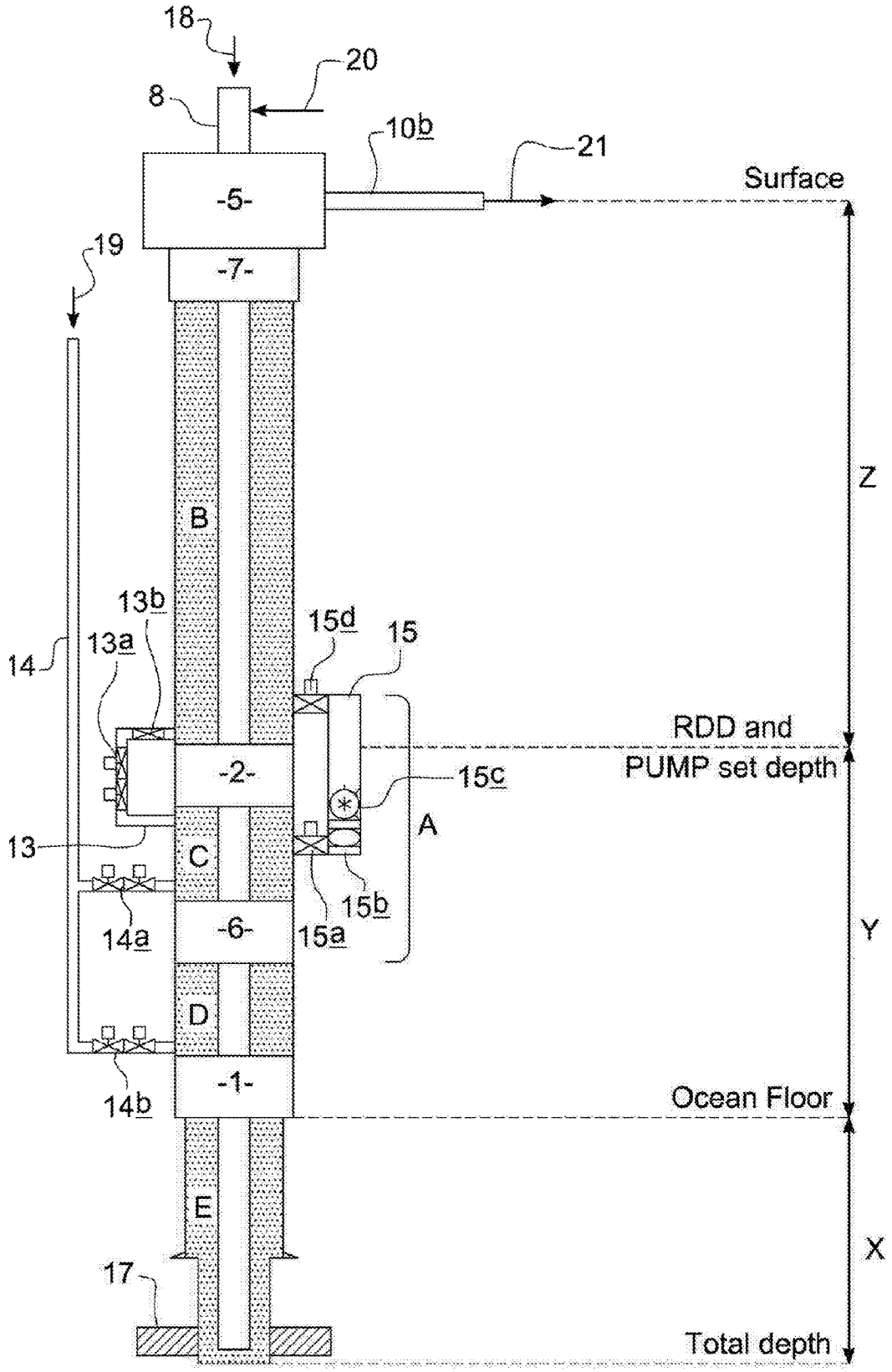
FIG. 4 shows an alternative embodiment of the embodiment shown in FIG. 3 when the modified riser module contains the RDD, QCA and submersible PCP's positioned at a deep set subsea depth and absence of a surface RDD or QCA.

Referring now to FIGS. 3 and 4, this shows an inventive riser assembly installed in a riser system on a floating installation using a deep subsea set RDD and QCA, and utilizing the rig's diverter system to seal off the riser at surface. This configuration, referred to as configuration 2, reduces the operating capabilities of the drilling system as it does not permit MPD or RGH operations due to the absence of a surface RDD or QCA, a flow spool, or an MPD or RGH system. These embodiments of the inventive system and method operate as an open system above the subsea RDD, with riser annulus B at atmospheric conditions. The primary safety measure for sealing the riser top and controlling any gas which may break out in riser annulus B above the RDD 2 is the rig's diverter 5. During pumped riser operations with the inventive system and method, all fluid returns are directed from the riser to the rig's diverter return flow line 10*b* and back to the rig's fluid treatment system 21. The diverter 5 is thus closed for managing any gas in the riser annulus B, C, D. All other aspects disclosed in FIGS. 3 and 4 are identical to those disclosed in FIGS. 1 and 2.

FIG. 3 shows a riser assembly with multiple opportunities for riser pressure control. For example, when the HDP 115 is shut-down, Applied Surface Back Pressure (ASBP) can be added to riser flow with the choke 13*b* on the bypass line 13. When the HDP 115 is running, the RDD seal can be relaxed slightly or the choke 13*b* on the bypass line 13 can be slightly cracked open to increase riser pressure.

Further, whether the HDP 115 is being operated or shut-down, the riser pressure can also be modulated by varying the booster pump 19 rate. The above options exist for pressure control in addition to varying the HDP 115 rate. However, in the event of a riser gas event, FIG. 3 still requires the use of conventional rig diverter system to manage the riser volume above the inventive system.

Figure 5:
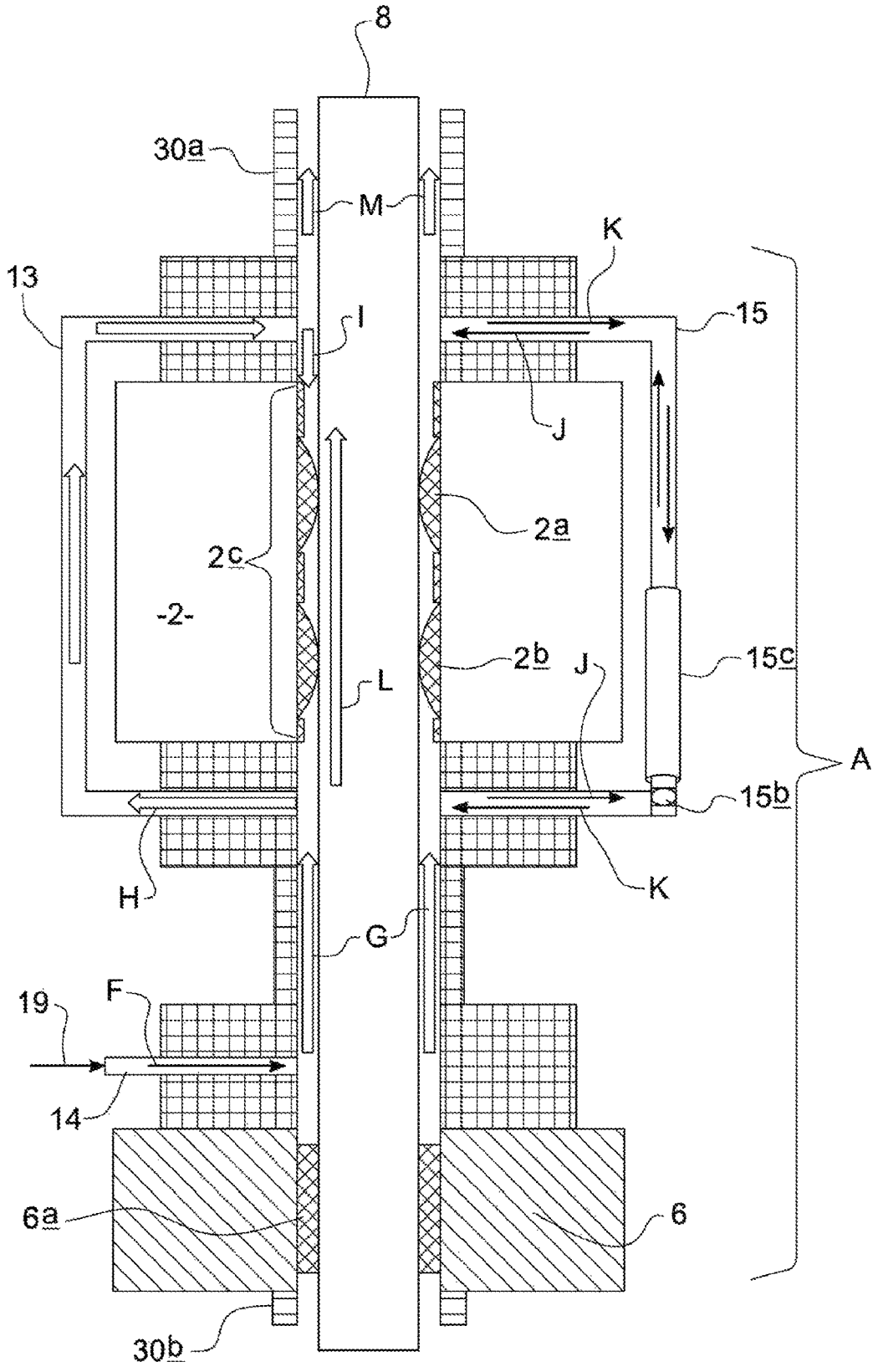
FIG. 5 shows a simplified cross section of a riser assembly according to the present invention illustrating the flushing points of the inventive system.

Referring now to FIG. 5, a simplified cross section illustrating the flushing points of the inventive system and method is shown. For the purpose of this description, only a single flow diversion line 15 and pump (HDP or PCP) are shown. As discussed above, more than one diversion line is typically provided. In an embodiment where HDP would be used, the system would, for example, have two HDP's per diversion line with one drive motor per diversion line powering each pair of HDP's.

The riser assembly A contains the RDD 2 and the QCA 6, the bypass line 13, and the flow diversion line(s) 15, and the pump (HDP or PCP) and is connected to the rig's riser system and the joints above it 30*a* (containing the riser annulus above) and the joints below it 30*b* (containing the drilling annulus below). The modified booster line 14 connects to a side outlet located on the riser module A' below the RDD 2. Drill pipe 8 extends from the surface, down through the riser annulus and through the dual seals 2*a* and 2*b* of the RDD 2 sealing assembly 2*c*, through the packer element 6*a* of the QCA 6, and into the wellbore. The dual sealing elements 2*a* and 2*b* of the RDD 2 seal sleeve assembly 2*c* remain closed on the drill pipe 8 to isolate the hydrostatic pressure in the riser annulus above 30*a* from the drilling annulus below 30*b*. The drill pipe 8 in this example is not rotating or reciprocating, and has been stopped because flushing is required due to extended drilling periods and settled solids within the system. The rig pump injection into the drill pipe 8 has also been stopped to perform flushing operations through the HDP 115, and to also prevent the pressurization of the drilling annulus 30*b* against the QCA 6 when it is closed. Another riser booster tie-in is directly above the RDD so that the top of the RDD seal can flushed free of cuttings.

Before flushing commences via the riser booster tie-in directly above the QCA, the QCA packer 6*a* is closed on the drill pipe 8 to isolate the drilling annulus below during flushing, and the riser booster pump 19 supplies fluid F to the modified riser booster line 14 connected to the riser module A. A highly turbulent fluid stream F enters the modified booster line 14 and enters the confined annular volume G between the closed QCA packer 6*a* and the closed RDD lower sealing element 2*b*, with several options for directing the clean flushing fluid through the system from this point G.

The bypass line 13 may also be used to direct the turbulent fluid stream F to the top area of the RDD sealing assembly 2*c*. The bypass line 13 is open and the flow diversion line 15 is closed. The turbulent fluid stream F enters the bypass line 13 and flow H diverts around the closed RDD 2. Upon exiting into the riser annulus 30*a* above the RDD 2, the turbulent stream I jets the area on top of the seal sleeve assembly 2*c*, clearing it of debris and circulating the flushing fluid to surface M through the upper riser volume 30*a*. Flow path H and I thus flushes solids which may have settled on top of the upper sealing element 2*a* and the seal sleeve assembly 2*c*, clearing debris so it does not enter the sealing face of elements 2*a* and 2*b* within the RDD 2. Flushing rapidly through the by-pass line also create turbulent flow around the filter screens when placed at the opening to the first port Ion the diversion lines 15. This can help remove or prevent a blockage in the filter screens.

Alternatively, the riser booster pump 19 supplies fluid F at the modified riser booster line 14 of the riser module to flush the flow diversion line 15. The bypass line 13 is closed and the flow diversion line 15 is open. Turbulent fluid from the confined annulus G between the RDD 2 and QCA 6 enters the flow diversion line 15, jetting the filtering assembly 15*b* and clearing it of solids with flow stream J. The turbulent stream J flushes the suction inlet to the pump (HDP or PCP), and the pump (HDP or PCP) is engaged to draw clean fluid through the pump heads at the same rate as the riser booster pump 19 is injecting fluid into the riser, discharging the fluid J into the riser annulus 30*a* above the RDD 2.

This clears the bypass line 15, filtering system 15*b* and pump heads of debris and circulates the flushing fluid into the upper riser volume 30*a* and to the surface M.

In embodiments where progressive cavity pumps are used, if the filtering system 15*b* is plugged, there is an option to reverse the pump 15*c* direction to back flush through the filter 15*b*. The riser booster pump injection 19 is stopped. The fluid in the riser annulus 30*a* above the RDD 2 is drawn into the pump 15*c* as flow K enters the flow diversion line 15. The pump 15*c* discharges the fluid K through the filter system 15*b*, clearing any large debris which may be plugging the filter 15*b* screen. The discharged fluid K may be circulated through the bypass line 13, up into the riser annulus 30*a*, and to the surface M. Alternately, the RDD sealing elements 2*a* and 2*b* may be relaxed providing a flow path L through the annular volume of the RDD 2. Fluid K from the diversion line 15 thus circulates through the flow path L of the RDD 2, into riser annulus 30*a*, and to the surface M.

The riser booster pump 19 injected fluid P can also be used to flush the annular volume of the RDD 2. The bypass line 13 and flow diversion line 15 are closed. The RDD sealing elements 2*a* and 2*b* are relaxed and a flow path L is provided for the turbulent flow stream F from the modified riser booster line 14, through the annular volume G, and through the annular volume of the RDD 2. This fluid circulates into the riser annulus above 30*a* and to the surface M. This removes solids which may have settled on the top of the RDD 2 seal sleeve assembly 2*c* and/or upper sealing element 2*a*.

The modified booster line may also be used to flush gas which may be trapped below the RDD 2 into the riser annulus 30*a* above the RDD 2, which is to then be safely handled by the rig's diverter system or an alternate RGH system.

When completed, the RDD sealing elements 2*a* and 2*b* are energized, the bypass line 13 is closed, the flow diversion line 15 is opened, the modified booster line 14 is closed, and the QCA 6 is opened. The pump (HDP or PCP) is synchronized with the drilling pump, and pumped riser operations continue. However, for operations where MPD-ASBP is required, the diversion lines 15 could be closed and flow could be directed toward the by-pass line 13 and choke 13*b*. Finally, by-pass line choke 13*b* and pump (HDP or PCP) could be used simultaneously to make fine adjustments to riser pressure. Additionally, the riser booster pump 19 rate can also be manipulated to make fine adjustments in riser pressure during this process.

FIG. 3 will now be reused to discuss the process flow logic of the riser system including the riser assembly according to the present invention in normal operations during its pumped riser method. This example assumes there is no surface QCA or RDD installed at the top of the riser, with several flow diversion lines contained within the modified riser module.

During drilling with the inventive system's pumped riser method, the rig's drilling pump 18 injects drilling fluid into the drill pipe 8 from the rig's fluid treatment system 21. The fluid is pumped at a specified rate to provide the necessary annular volumes are achieved for hole cleaning. The fluid exits the drill string 8 through the bit and enters into the wellbore annulus E. The fluid is circulated up through the annular volumes of the SSBOP 1, the modified riser module A' containing the QCA 6, the RDD 2, and two flow diversion lines 15. Each of the flow diversion lines contain a set of remotely operated isolation valves 15*a*, 15*d*, a filtering system 15*b*, and a pump (HDP 115, or PCP 15*c*, 15*g*, 15*k*). A bypass line 13 and two modified riser booster flushing lines 14 are connected to the riser module at side outlets on its housing.

The returned drilling fluid continues to circulate to surface, passing through the annular volume of the rig's telescopic joint 7 and diverter 5 at surface. All returned flow is diverted to the diverter 5 return flow line which directs fluid back to the rig's fluid treatment system 21. The returned fluid flows under atmospheric pressure from the riser.

During the inventive system's pumped riser method, the RDD 2 is closed to produce a non-rotating seal around the drill pipe 8. The hydrostatic pressure of the riser annulus above the RDD 2 is immediately isolated from the wellbore annulus E. The subsea installation depth of the modified riser module A, A', and hence the subsea setting depth of the RDD 2, is determined by the desired value of the ECD to offset during the drilling of the wellbore E. The deeper the modified riser module is set, the more the ECD value can be offset during drilling because the RDD 2 isolates an even greater degree of the hydrostatic pressure acting through the length of the riser at deeper water depths. The pump may be used to offset more than ECD if desired. Once the RDD 2 is closed, drill pipe rotation and reciprocation is permitted through its seal.

During drilling with the inventive system's pumped riser method the valves on the bypass line 13 and the riser booster lines 14 are in the closed position. Flow is directed through the pump modules 115 on both flow diversion lines. The driver motors are synchronized with one another such that all four pumps net a constant flow rate.

The pump (HDP 115, or PCP 15*c*) speed is synchronized with the rig pump 18 speed as well, such that the pump (HDP 115, or PCP 15*c*) draws fluid from the wellbore E below the closed RDD 2 at a rate equal to the injection rate into the drill pipe 8 with the rig drilling pump 18. Flow into the wellbore E thus equals flow out of the wellbore E and the pump (HDP 115, or PCP 15*c*) does not lose suction. The pump (HDP 115, or PCP 15*c*) pumps the returned fluid from the wellbore E below the RDD 2 sealing point and discharges the fluid into the riser annulus above the closed RDD 2. Any particles large enough to exceed the operating tolerances of the pump (HDP 115, or PCP 15*c*) and disrupt the operation of the HDP heads 115*c* are filtered out through the upstream filter system 15*b*. All returned fluid entering the suction inlet of the pump (HDP 115, or PCP 15*c*) passes through the upstream filtering system 15*b*. Without the filtering system 15*b* in place, the probability of a blockage increases which could degrade the performance of the pump (HDP 115, or PCP 15*c*).

As the pump (HDP 115, or PCP 15*c*) is operating at a speed equal to the rig drilling pump 18, a constant fluid level is maintained in the riser above the closed RDD 2 which permits drilling with a full fluid column in the riser. Furthermore, as the output of the pump (HDP 115, or PCP 15*c*) is equal to the output of the rig drilling pump 18, there is no increase in the wellbore E pressure below the closed RDD 2 as a result of the returned fluid backing up at the suction inlet to the pump heads. This would be an undesired event and could force the wellbore E pressure beyond the fracture pressure of the formation.

A differential pressure is thus created across the pump (HDP 115, or PCP 15*c*) as it pumps fluid from below the closed RDD 2 at a lower pressure and discharges it to the riser annulus above the RDD 2 at a higher pressure. The differential is approximately equal to the amount of wellbore pressure reduction desired. The mechanical design of the HDP 115 prevents leakage and/or reverse flow back through the pump when it is engaged or at rest. Furthermore, under static conditions, it prevents the pressure imposed from the hydrostatic pressure above the RDD 2 from communicating with the wellbore E annulus below the RDD 2 which would otherwise force the wellbore E pressure upwards.

Once the returned fluid is discharged from the HDP 115 into the riser annulus above the closed RDD 2, it continues to circulate to surface, exiting the riser through the diverter 5 return flow line and into the rig's fluid treatment system 21.

If at some stage a flow diversion line plugs off, the drive motor on the other diversion line will compensate to handle the full riser return flow. A failure of a pump head means that the diaphragm in the pump head enclosure fails or debris prevent a tight. Under the circumstance of failed diaphragm, the enclosure which houses the failed diaphragm can withstand high pressures and will contain the flow of drilling returns as well as operate with reduced efficiency. If a pump head fails, flow can still progress through 3 out of the 4 pump heads will full efficiency and through the failed pump head with degraded efficiency. This level system of redundancy permits operations to continue despite failures.

During any solids plug off event within the active flow diversion line, flushing procedures commence to clear the line of debris, described herein. Turbulent flow is introduced through the modified riser booster line tie-in's by the injection of clean drilling fluid with the riser booster pump 19. The modified riser booster line isolation valves 14*a* are opened and flushing procedures commence, disclosed in FIG. 5.

The riser booster pump 19 may be used to increase the flow rates and annular velocities in the riser annulus during conventional drilling operations by introducing fluid through the isolation valves 14*b*, fluid entering annulus D via port VI. However, during the system's pumped riser method, this injection point generally remains inactive unless the annular velocities in the riser at the given drilling pump 19 injection rates are not sufficient. If injection is required through 14*b*, the pump (HDP 115, or PCP 15*c*) speed must be increased such that its output equals the sum of the drilling pump 18 and riser booster pump 19 rates. This maintains a constant fluid level in the riser and prevents the additional flow from the riser booster pump 19 from pressuring up the wellbore E.

During a well control event, the rig SSBOP 1 is closed, the HDP system is stopped. The wellbore E returns are directed to the rig choke manifold and mud gas separator (not shown). The rig pumps 18 are used to circulate and remove the influx from the wellbore E through the choke manifold and mud gas separator, where gas is separated from the fluid and vented to a safe area up the derrick and away from the rig. This describes a conventional well control process. Any gas that has escaped above the SSBOP can migrate through the pump heads which permit one way flow and be handled with the rig's diverter system or with a QCA/RDD installed beneath the telescopic slip joint if available.

Another option is to close the isolation valves 15*a*, 15*d* on the flow diversion lines 15 and open the isolation valve 13*a* on the by-pass line 13 to permit the choke 13*b* to slowly bleed any riser gas in stages. This allows the rig's diverter system to more safely manage the flow of gas.

Furthermore, if the RDD 2 fails or leaks during normal operations, the QCA 6 is closed to isolate the hydrostatic pressure of the riser from the wellbore E below while the sealing assembly is replaced. The other purpose of having QCA 6 in place is that it allows for retrieval of the RDD 2 sealing assembly with the wellbore isolated.

There are two pressure breaks in the system, at the SSBOP 1 and riser interface 26, and at the riser telescopic joint interface 27. The pressure rating of the modified riser module A is greater than or equal to the pressure capacity of the riser in which it is installed. The pressure capacity of the overall drilling system thus decreases at these points 26 and 27 as the fluid circulates towards the surface, with the modified riser module maintaining the pressure capacity of the riser.

Figure 6:
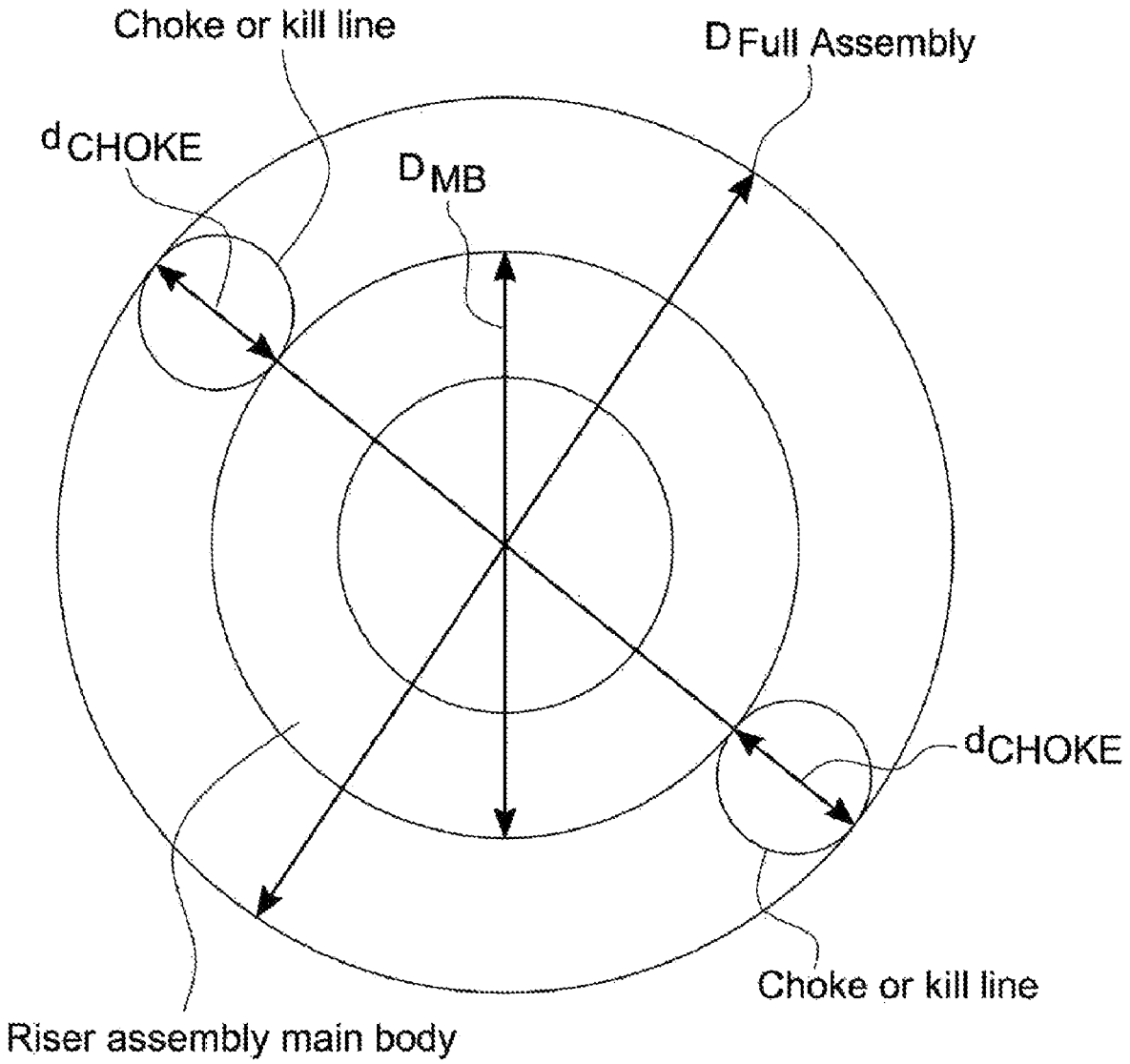
FIG. 6 shows a scaled and simplified engineering schematic of a transverse cross-section through a riser assembly according to the present invention, revealing the modified riser module of the inventive system contained within the maximum outer diameter (OD) design envelope of 57.5 inches.

FIG. 6 shows of a transverse cross-section through a riser assembly according to the present invention. It shows that the riser assembly main body together with the two kill or choke lines which are each physically in contact with the riser assembly main body define a specific diameter, referred to as the full assembly diameter ($D_{Full\ Assembly}$). The full assembly diameter is such that it can drift through a 60.5" rotary table which represents a great advantage considering the ease of installation and gain of time.

Indeed, if $d_{CHOKE}$ stands for the kill or choke line diameter and $D_{MB}$ stands for the riser assembly main body diameter, then:

$$D_{MB}+d_{CHOKE}+d_{CHOKE}D_{Full\ Assembly}$$

According to the present invention, $$D_{MB}\leq 46.5'' \text{ and } d_{CHOKE}\leq 6.75'', \text{therefore } D_{Full\ Assembly}\leq 60''.$$

Having a full assembly diameter equals 60" provides that the riser assembly and choke or kill lines are packaged such that they can be drifted all together through a 60.5" rotary table.

The pumped riser module is assembled onto a flow spool piece with similar design and mechanical characteristics to a joint of riser. For example, a tube of riser may have an OD of 22" and an ID of 19.25". The hollow space in the center of the flange sketch depicts that 19.25" drift diameter of the system. Moving outward from the flange, the OD of the QCA and RDD is depicted. This system can drift through the 49" rotary table without rigid, choke, kill, and booster lines. The system is further depicted with four pump heads 115*c*, two drive motors 115*a*, and two flow diversion lines 15 attached the flow spool 3. Also shown are the typical riser choke, kill, and booster, and BOP hydraulic lines. The transverse cross section demonstrates that these items can be packaged together to drift through a 60.5" rotary table. Engineering costs can be further reduced by packaging these components for drift through the 75.5" rotary table. FIG. 6 does not depict the addition of the riser booster tie-ins and by-pass line with choke. However, these are also envisioned to fit within a package that can be drifted through the rotary table. This also includes isolation valves previously discussed.

This compacted configuration allows the modified riser module according to the present invention to be easily connected to the rig's riser joints on the rig floor using a rig spider and lowering it through the rotary table, which are normal procedures during the running of the riser system. Installation complexities are thus eliminated which is a major difference when compared to other pumped riser systems with large dimensions, requiring their installation through the side of the moon pool area.

It should be appreciated that whilst, the above description, the use of RDDs and QCA in accordance with the applicant's prior designs is specified, these need not be used, and any standard configuration of subsea blowout preventer or similar sealing device could be used instead.

Figure 7:
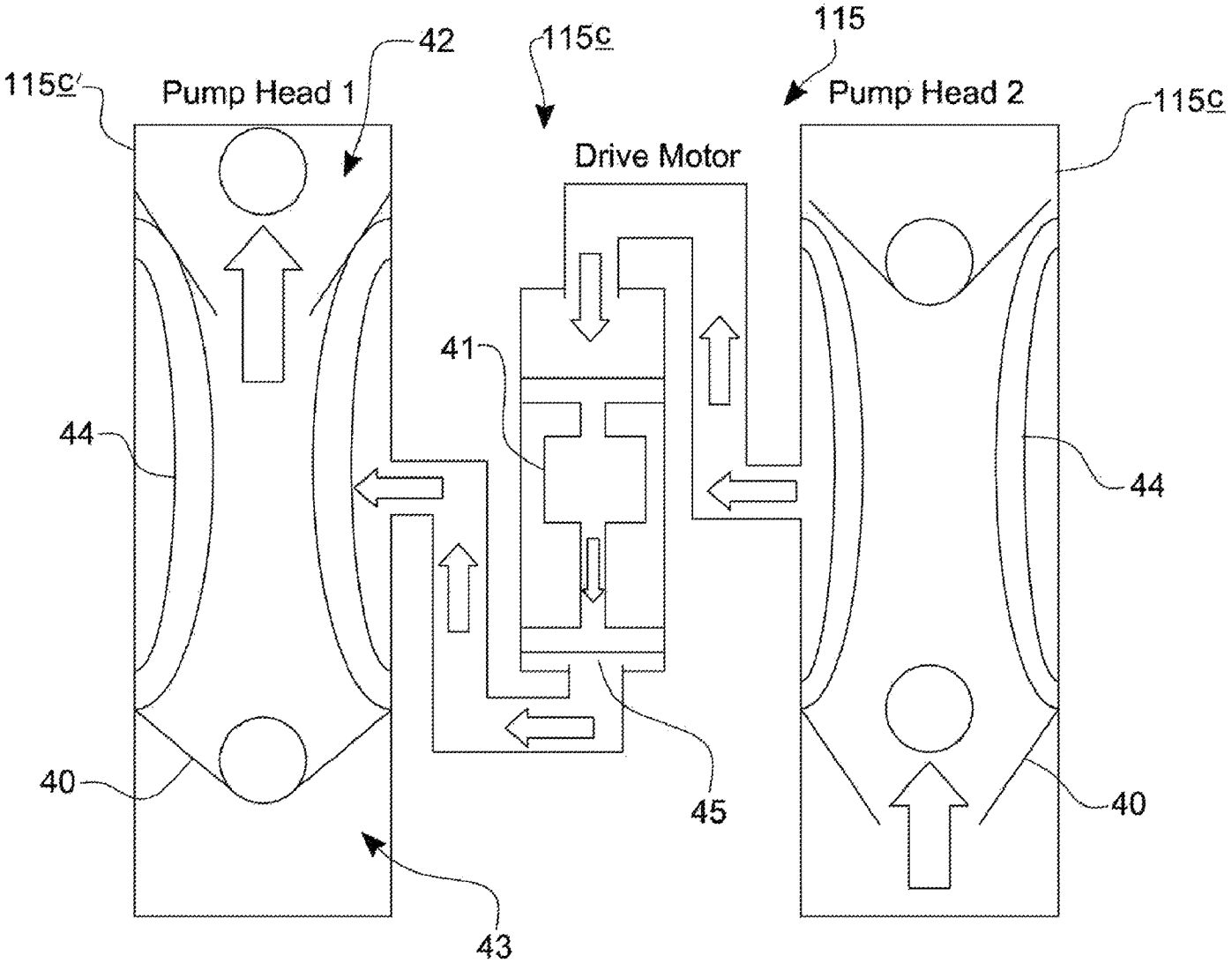
FIG. 7 shows a vertical cross section of generic hose diaphragm pump 115 system to illustrate the physics of how this pump system functions.

FIG. 7 depicts a vertical cross section of generic hose diaphragm pump 115 system to illustrate the physics of how this pump system functions. FIG. 7 shows two hose diaphragm pump heads 115*c* which are driven simultaneously by an electric drive motor 115*a*. The entire unit is placed subsea on the riser and powered by an electrical umbilical. Each pump head 115*c* contains a dual lined diaphragm 44 made of materials that are compatible with a wide range of wellbore fluids. The term "hose" in HDP is derived from the use of this liner. Each pump head 115*c* also has a check valve 42 at the inlet and a check valve 40 at the outlet of the pump head 115*c*. The check valves 40, 42 are internal to the hose diaphragm pump heads 115*c*. Each pair of pump heads 115*c* is driven by a subsea electric motor 115*a* which is comprised of a dual acting piston 41. When the piston 41 takes a down stroke, as shown in FIG. 7, the hose diaphragm 44 at left is actively compressed via the compression of control systems fluid which is in pressure communication with the piston face 45 and the hose diaphragms 44. When the diaphragm is compressed, the drilling return fluid within the diaphragm is forced upward. The check valves 40, 42 provide that the flow through the pump head 115*c* is always upward. As such, the check valve 42 at the HDP head 115*c* outlet is open to permit flow into the upper riser section. The check valve 40 at the inlet is forced closed to reject flow in the downward direction. Since the drive motor 115*a* is dual acting, the opposite is occurring with the other pump head 115*c* at right. In this case, the piston 41 is retracting, creating a vacuum force which causes the hose diaphragms 44 to expand and fill up with drilling return fluid. In this case, the upper check valve 42 rejects flow and the lower check valve 40 permits flow due to the vacuum forces expanding the volume inside the diaphragm. The debris clearance past the check valves is 2" which is considered to be suitable for drilling systems. Furthermore, the check valves have an additional advantage that when the pump is shut down, the pathway upward through the flow diversion lines remain open. As such, the HDP 115 "fails open". Furthermore, if sealing efficiency with the check valves has ever worn away, the isolation valves on the flow diversion lines could be operated in synchronization with the driver motor to deliver the same pump performance. Having the isolation valves operating in a synchronized fashion with the drive motor, is an interesting advantage of the present invention due to the localization of the isolation valves between the HDP 115 and first port I and between the HDP 115 and second port II.

The opposite behavior happens when the drive motor takes a stroke in the opposite direction.

The present invention uses at least two drive motors 115*a* each driving a pair of pump heads 115*c* installed on the riser module. Each motor and pump head pair provide lift to the riser flow going through a designated flow diversion line. By synchronizing the drive motors, the flow out of the pump system is expected to be very smooth.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof.

What is claimed is:

1. A riser assembly comprising:

a main body comprising a first end, a second end, a longitudinal axis, a first port, and a second port, the main body being configured to enclose a main body main passage which extends from the first end to the second end generally parallel to the longitudinal axis and to be mounted in a riser so that that the main body main passage forms a part of a main passage of the riser, wherein, the first port and the second port are configured to extend through the main body to connect the main body main passage with an exterior of the main body;

a tubular extending along the main body main passage;

a first sealing assembly arranged in the main body between the first port and the second port, the first sealing assembly being configured to provide a seal between the main body and the tubular so as to substantially prevent a flow of a fluid along the main body main passage around the tubular;

at least two diversion lines each of which extend from the first port in the main body to the second port in the main body; and a pump arranged within each of the at least two diversion lines, each pump being configured to pump a fluid along a respective diversion line in which the pump is arranged, wherein, each pump is a hose diaphragm pump system which comprises at least two hose diaphragm pump heads and a drive motor, the drive motor being configured to simultaneously power the at least two hose diaphragm pump heads, the main body further comprises an additional port which is arranged directly above the first sealing assembly, and the riser assembly further comprises a booster line tie-in which is configured to extend to the additional port.

2. The riser assembly as recited in claim 1, wherein, each of the at least two diversion lines comprises a main portion which extends generally parallel to the longitudinal axis of the main body, and each of the at least two diversion lines is arranged to abut on or be directly adjacent to the main body.

3. The riser assembly as recited in claim 1, wherein each pump is a pump module which comprises at least two pumps which are arranged in parallel.

4. The riser assembly as recited in claim 1, wherein each pump is a progressive cavity pump.

5. The riser assembly as recited in claim 1, wherein each pump is a pump module which comprises two pumps which are arranged in series.

6. The riser assembly as recited in claim 1, wherein each pump is configured to pump the fluid along the respective diversion line from the first port to the second port.

7. The riser assembly as recited in claim 1, wherein each pump is configured to prevent a flow of the fluid along the respective diversion line from the second port to the first port.

8. The riser assembly as recited in claim 1, wherein each of the at least two diversion lines comprises a separate first port and a separate second port.

9. The riser assembly as recited in claim 1, wherein, the main body further comprises a third port which is configured to connect the main body main passage to the exterior of the main body, and further comprising:

a booster line configured to extend to the third port in the main body.

10. The riser assembly as recited in claim 1, wherein, the main body further comprises a fourth port and a fifth port, the fourth port and the fifth port each being configured to connect the main body main passage to the exterior of the main body, and the first sealing assembly is arranged between the fourth port and the fifth port, and further comprising:

a by-pass line configured to extend between the fourth port and the fifth port.

11. The riser assembly as recited in claim 1, further comprising:

a second sealing assembly configured to provide a seal between the main body and the tubular so as to substantially prevent the flow of the fluid along the main body main passage around the tubular, wherein, the first port is arranged between the first sealing assembly and the second sealing assembly.

12. A riser assembly comprising:

a riser body comprising a first end, a second end, a longitudinal axis, a first port, a second port, and a third port, the riser body being configured to enclose a riser body main passage which extends from the first end to the second end generally parallel to the longitudinal axis, wherein, the second end of the riser body is connected to a subsea blowout preventer which is suitable for mounting on a wellhead, the first port and the second port are configured to extend through the riser body to connect the riser body main passage with an exterior of the riser body, and the third port is configured to connect the riser body main passage to the exterior of the riser body;

a tubular configured to extend along the riser body main passage;

a first sealing assembly arranged in the riser body between the first port and the second port, the first sealing assembly being configured to provide a seal between the riser body and the tubular so as to substantially prevent a flow of a fluid along the riser body main passage around the tubular;

a second sealing assembly configured to provide a seal between the riser body and the tubular so as to substantially prevent the flow of the fluid along the riser body main passage around the tubular;

a diversion line configured to extend from the first port in the main body to the second port in the main body;

a pump arranged within the diversion line, the pump being configured to pump a fluid along the diversion line from the first port to the second port;

a riser booster pump; and a booster line comprising a first branch, the booster line being configured to extend from the riser booster pump so that the first branch extends to the third port, wherein, the third port is arranged in the riser body between the first sealing assembly and the second sealing assembly or directly above the first sealing assembly.

13. The riser assembly as recited in claim 12, wherein the booster line further comprises a second branch which extends into the riser body main passage at the second end of the riser body.

14. The riser assembly as recited in 12, wherein, the riser body further comprises a fourth port and a fifth port, the fourth port and the fifth port being configured to connect the riser body main passage to the exterior of the riser body, and the first sealing assembly is arranged between the fourth port and the fifth port, and further comprising:

a by-pass line configured to extend between the fourth port and the fifth port.

15. A method of operating a riser assembly, the riser assembly comprising:

a riser body comprising a first end, a second end, a longitudinal axis, a first port, a second port, and a third port, the riser body being configured to enclose a riser body main passage which extends from the first end to the second end generally parallel to the longitudinal axis, wherein, the first port and the second port are configured to extend through the riser body to connect the riser body main passage with an exterior of the riser body, and the third port is configured to connect the riser body main passage to the exterior of the riser body;

a tubular configured to extend along the riser body main passage;

a first sealing assembly arranged in the riser body between the first port and the second port, the first sealing assembly being configured to provide a seal between the riser body and the tubular so as to substantially prevent a flow of a fluid along the riser body main passage around the tubular;

a second sealing assembly configured to provide a seal between the riser body and the tubular so as to substantially prevent the flow of the fluid along the riser body main passage around the tubular;

a diversion line configured to extend from the first port in the main body to the second port in the main body;

a pump arranged in the diversion line, the pump being configured to pump a fluid along the diversion line from the first port to the second port;

a riser booster pump; and a booster line comprising a first branch, the booster line being configured to extend from the riser booster pump to the third port, wherein, the third port is arranged in the riser body between the first sealing assembly and the second sealing assembly or directly above the first sealing assembly;

the method comprising:

operating the second sealing assembly to seal against the tubular; and operating the riser booster pump to pump a fluid into the riser body main passage via the third port.

16. The method as recited in claim 15, wherein, the riser body further comprises a fourth port and a fifth port, the fourth port and the fifth port being configured to connect the riser body main passage to the exterior of the riser body, and the first sealing assembly is arranged between the fourth port and the fifth port, and the riser assembly further comprises:

an isolation valve arranged in the diversion line, the isolation valve being configured to move between a first configuration in which the isolation valve permits the flow of the fluid along the diversion line, and a second configuration in which the isolation valve substantially prevents the flow of the fluid along the diversion line, the isolation valve being arranged between the pump and the second port or between the pump and the first port;

a by-pass line configured to extend between the fourth port and the fifth port; and a by-pass isolation valve configured to move between a first configuration in which the by-pass isolation valve permits a flow of a fluid along the by-pass line, and a second configuration in which the by-pass isolation valve substantially prevents the flow of the fluid along the by-pass line.

17. The method as recited in claim 16, further comprising:

operating the first sealing assembly to seal against the tubular;

operating the isolation valve to substantially prevent the flow of the fluid along the diversion line; and opening the by-pass isolation valve so as to permit the flow of the fluid along the by-pass line.

18. The method as recited in claim 16, further comprising:

operating the first sealing assembly to seal against the tubular;

operating the isolation valve to permit the flow of the fluid along the diversion line; and closing the by-pass isolation valve to substantially prevent the flow of the fluid along the by-pass line.

19. The method as recited in claim 16, further comprising:

operating the first sealing assembly so that the first sealing assembly does not seal against the tubular;

operating the isolation valve in the diversion line to substantially prevent the flow of the fluid along the diversion line; and operating the bypass isolation valve to substantially prevent the flow of the fluid along the bypass line.

20. The method as recited in claim 15, further comprising:

operating the pump in the diversion line to pump the fluid along the diversion line from the first port to the second port.

21. The method as recited in claim 15, wherein, the riser assembly further comprises at least one of:

a pump module;

a choke arranged on the by-pass line; and a rig mud pump, and, the method further comprises controlling a riser pressure by at least one of:

modulating a speed of the pump module, varying a rate of the riser booster pump, relaxing or tightening at least one of the first sealing assembly and the second sealing assembly, modulating the choke on the by-pass line to adjust a riser pressure, and modulating the rig mud pump.

* * * * *